US008713752B2

(12) United States Patent
Kang

(10) Patent No.: US 8,713,752 B2
(45) Date of Patent: May 6, 2014

(54) VACUUM CLEANER

(75) Inventor: Sung Su Kang, Changwon (KR)

(73) Assignee: LG Electronics Inc., Seoul (KR)

( * ) Notice: Subject to any disclaimer, the term of this patent is extended or adjusted under 35 U.S.C. 154(b) by 542 days.

(21) Appl. No.: 12/720,160

(22) Filed: Mar. 9, 2010

(65) Prior Publication Data

US 2010/0229332 A1 Sep. 16, 2010

Related U.S. Application Data

(60) Provisional application No. 61/160,048, filed on Mar. 13, 2009.

(51) Int. Cl.
*A47L 9/10* (2006.01)
*A47L 9/20* (2006.01)

(52) U.S. Cl.
USPC ..... 15/352; 15/347; 15/348

(58) Field of Classification Search
USPC ..... 15/352, 347, 348
See application file for complete search history.

(56) References Cited

U.S. PATENT DOCUMENTS

| | | | | |
|---|---|---|---|---|
| 83,469 | A | 10/1868 | Crandall | |
| 2,283,836 | A | 5/1942 | White | 183/38 |
| 2,714,426 | A | 8/1955 | White | 183/58 |
| 3,367,462 | A | 2/1968 | Bibbens | 192/55 |
| 4,379,385 | A | 4/1983 | Reinhall | 56/16.6 |
| 4,545,794 | A | 10/1985 | Himukai | 55/362 |
| 4,601,082 | A | 7/1986 | Kurz | 15/319 |
| 4,617,034 | A | 10/1986 | Ikezaki et al. | 55/276 |
| 4,809,394 | A | 3/1989 | Suka et al. | 15/327 |
| 5,033,151 | A | 7/1991 | Kraft et al. | 15/319 |
| 5,135,552 | A | 8/1992 | Weistra | 55/337 |
| 5,159,738 | A | 11/1992 | Sunagawa et al. | 15/326 |
| 5,233,682 | A | 8/1993 | Abe et al. | 395/61 |
| 5,251,358 | A | 10/1993 | Moro et al. | 15/319 |
| 5,265,305 | A | 11/1993 | Kraft et al. | 15/319 |
| 5,323,483 | A | 6/1994 | Baeg | 288/811 |
| 5,542,146 | A | 8/1996 | Hoekstra et al. | 15/319 |
| 6,192,550 | B1 | 2/2001 | Hamada et al. | |
| 6,460,217 | B2 | 10/2002 | Fukushima et al. | 15/346 |
| 6,572,668 | B1 | 6/2003 | An et al. | |
| 6,589,306 | B2 | 7/2003 | Ronning et al. | |
| 6,625,845 | B2 | 9/2003 | Matsumoto et al. | 15/353 |
| 6,689,225 | B2 | 2/2004 | Illingworth | 134/21 |

(Continued)

FOREIGN PATENT DOCUMENTS

| | | | |
|---|---|---|---|
| AU | 2005229774 | A1 | 8/2006 |
| AU | 2007200406 | B2 | 9/2007 |

(Continued)

OTHER PUBLICATIONS

Korean Office Action dated Sep. 17, 2010 issued in Application No. 10-2008-0065806.

(Continued)

*Primary Examiner* — Bryan R Muller
(74) *Attorney, Agent, or Firm* — KED & Associates LLP

(57) ABSTRACT

A vacuum cleaner is provided. The vacuum cleaner may include a vacuum cleaner, comprising a main body, and a dust separator selectively on the main body, the dust separator comprising a dust separation device, a dust compression device having at least one compression member disposed therein, the at least one compression member being configured to be rotated to compress dust, and a storage device.

17 Claims, 26 Drawing Sheets

(56) References Cited

U.S. PATENT DOCUMENTS

| | | | | |
|---|---|---|---|---|
| 6,694,917 | B1 | 2/2004 | Wang | 119/51.11 |
| 6,735,816 | B2 | 5/2004 | Oh et al. | 15/353 |
| 6,757,933 | B2 | 7/2004 | Oh et al. | 15/353 |
| 6,779,229 | B2 | 8/2004 | Lee et al. | 15/329 |
| 6,782,584 | B2 | 8/2004 | Choi | 15/352 |
| 6,922,868 | B1 | 8/2005 | Jeong | 15/353 |
| 7,028,369 | B2 | 4/2006 | Park et al. | 15/353 |
| 7,152,276 | B2 | 12/2006 | Jin et al. | 15/352 |
| 7,160,347 | B2 | 1/2007 | David et al. | |
| 7,351,269 | B2 | 4/2008 | Yau | 55/297 |
| 7,475,449 | B2 | 1/2009 | Lee | 15/326 |
| 7,481,868 | B2 | 1/2009 | Lee et al. | 95/273 |
| 7,547,340 | B2 | 6/2009 | Park | 55/429 |
| 7,582,128 | B2 | 9/2009 | Hwang et al. | 55/337 |
| 7,601,188 | B2 | 10/2009 | Hwang et al. | 55/343 |
| 7,608,123 | B2 | 10/2009 | Pineschi | 55/429 |
| 7,640,625 | B2 | 1/2010 | Oh et al. | 15/352 |
| 7,644,469 | B2 | 1/2010 | Beers et al. | 15/319 |
| 7,647,672 | B2 | 1/2010 | Nam et al. | 15/352 |
| 7,704,290 | B2 | 4/2010 | Oh | 55/295 |
| 7,749,295 | B2 | 7/2010 | Hwang et al. | 55/428 |
| 7,770,253 | B2 | 8/2010 | Ha et al. | 15/319 |
| 7,785,381 | B2 | 8/2010 | Oh et al. | 55/300 |
| 7,785,396 | B2 | 8/2010 | Hwang et al. | 95/1 |
| 7,854,782 | B2 | 12/2010 | Oh et al. | 55/429 |
| 7,951,216 | B2 | 5/2011 | Ha et al. | |
| 7,958,598 | B2 | 6/2011 | Yun et al. | |
| 2001/0025395 | A1 | 10/2001 | Matsumoto et al. | 15/353 |
| 2002/0073505 | A1 | 6/2002 | Bolden | 15/340.1 |
| 2002/0088079 | A1 | 7/2002 | Oh | 15/352 |
| 2002/0124538 | A1 | 9/2002 | Oh et al. | 55/426 |
| 2004/0211025 | A1 | 10/2004 | Jung et al. | 15/353 |
| 2004/0261216 | A1 | 12/2004 | Choi et al. | 15/352 |
| 2005/0091787 | A1 | 5/2005 | Bair et al. | 15/353 |
| 2005/0138763 | A1 | 6/2005 | Tanner et al. | 15/353 |
| 2005/0172584 | A1 | 8/2005 | Oh et al. | 55/345 |
| 2005/0252179 | A1 | 11/2005 | Oh et al. | 55/337 |
| 2006/0048491 | A1* | 3/2006 | Pineschi | 55/428 |
| 2006/0123750 | A1 | 6/2006 | Lee et al. | 55/428 |
| 2006/0230722 | A1 | 10/2006 | Oh et al. | |
| 2007/0136980 | A1 | 6/2007 | Fujiwara et al. | 15/339 |
| 2007/0143953 | A1 | 6/2007 | Hwang et al. | 15/353 |
| 2007/0209149 | A1 | 9/2007 | Lee | 15/352 |
| 2007/0209339 | A1 | 9/2007 | Conrad | 55/345 |
| 2008/0023035 | A1 | 1/2008 | Ha et al. | 134/18 |
| 2008/0023036 | A1* | 1/2008 | Ha et al. | 134/21 |
| 2008/0047094 | A1 | 2/2008 | Ha et al. | 15/347 |
| 2008/0052870 | A1 | 3/2008 | Lee et al. | 15/350 |
| 2008/0172824 | A1 | 7/2008 | Yun et al. | 15/352 |
| 2008/0172993 | A1 | 7/2008 | Yun et al. | 55/337 |
| 2008/0263816 | A1 | 10/2008 | Oh et al. | 15/347 |
| 2008/0264007 | A1 | 10/2008 | Oh et al. | 55/304 |
| 2008/0264014 | A1 | 10/2008 | Oh et al. | 55/423 |
| 2008/0264015 | A1 | 10/2008 | Oh et al. | 55/429 |
| 2008/0264016 | A1* | 10/2008 | Oh et al. | 55/429 |
| 2009/0178231 | A1 | 7/2009 | Hwang et al. | 15/347 |
| 2009/0178235 | A1 | 7/2009 | Yun et al. | 15/352 |
| 2009/0178236 | A1 | 7/2009 | Yun et al. | 15/352 |
| 2009/0229072 | A1 | 9/2009 | Hwang et al. | 15/352 |
| 2009/0229073 | A1 | 9/2009 | Hwang et al. | 15/352 |
| 2009/0235956 | A1 | 9/2009 | Hwang et al. | 134/21 |
| 2009/0241286 | A1 | 10/2009 | Hwang et al. | 15/347 |
| 2009/0249578 | A1 | 10/2009 | Hwang et al. | 15/352 |
| 2009/0255083 | A1 | 10/2009 | Hwang et al. | 15/347 |
| 2009/0266382 | A1 | 10/2009 | Hwang et al. | 134/21 |
| 2009/0293221 | A1 | 12/2009 | Hwang et al. | 15/347 |
| 2009/0293223 | A1 | 12/2009 | Hwang et al. | 15/352 |
| 2009/0293224 | A1 | 12/2009 | Hyun et al. | 15/353 |
| 2009/0293915 | A1 | 12/2009 | Hwang et al. | 134/21 |
| 2010/0132319 | A1 | 6/2010 | Ashbee et al. | |
| 2010/0263161 | A1 | 10/2010 | Lee et al. | |

FOREIGN PATENT DOCUMENTS

| | | | |
|---|---|---|---|
| CN | 2162679 | Y | 4/1994 |
| CN | 2186039 | Y | 12/1994 |
| CN | 2409894 | Y | 12/2000 |
| CN | 1334061 | A | 2/2002 |
| CN | 1434749 | A | 8/2003 |
| CN | 1593324 | A | 3/2005 |
| CN | 1695537 | A | 11/2005 |
| CN | 1695538 | A | 11/2005 |
| CN | 1777385 | A | 5/2006 |
| CN | 1778246 | A | 5/2006 |
| DE | 102 40 618 | A1 | 9/2003 |
| EP | 0 373 353 | | 6/1990 |
| EP | 0 375 327 | | 6/1990 |
| EP | 0 681 808 | | 11/1995 |
| EP | 1 136 028 | B1 | 9/2001 |
| EP | 1 371 318 | A2 | 12/2003 |
| EP | 1 671 569 | | 6/2006 |
| EP | 1 671 570 | A1 | 6/2006 |
| EP | 1 733 669 | A1 | 12/2006 |
| EP | 1 857 032 | A2 | 11/2007 |
| FR | 2 823 091 | A1 | 10/2002 |
| GB | 2 368 516 | A | 5/2002 |
| GB | 2 377 881 | A | 1/2003 |
| GB | 2 388 769 | B | 4/2004 |
| GB | 2 404 887 | A | 2/2005 |
| GB | 2 406 064 | A | 3/2005 |
| GB | 2 416 721 | A | 2/2006 |
| GB | 2466625 | | 6/2010 |
| JP | 1972-14759 | | 8/1972 |
| JP | 50-22355 | | 3/1975 |
| JP | 53-051663 | | 5/1978 |
| JP | 54-028457 | | 3/1979 |
| JP | 54-51259 | | 4/1979 |
| JP | 54-085560 | A | 7/1979 |
| JP | 54-085561 | A | 7/1979 |
| JP | 54-112357 | | 8/1979 |
| JP | 54-114358 | U | 8/1979 |
| JP | 54-114366 | U | 8/1979 |
| JP | 54-114367 | U | 8/1979 |
| JP | 54-119272 | U | 8/1979 |
| JP | 54-161751 | A | 12/1979 |
| JP | 55-074553 | U | 5/1980 |
| JP | 56-26044 | U | 3/1981 |
| JP | 58-84066 | A | 5/1983 |
| JP | 58-175532 | A | 10/1983 |
| JP | 58-218934 | A | 12/1983 |
| JP | 59-125354 | U | 8/1984 |
| JP | 64-029246 | A | 1/1989 |
| JP | 02-007927 | A | 1/1990 |
| JP | 4-116933 | U | 10/1992 |
| JP | 06-054778 | A | 3/1994 |
| JP | 07-241265 | A | 9/1995 |
| JP | 07-313412 | | 12/1995 |
| JP | 08-000514 | A | 1/1996 |
| JP | 08-112223 | A | 5/1996 |
| JP | 08-140907 | A | 6/1996 |
| JP | 10-243900 | A | 9/1998 |
| JP | 11-004789 | A | 1/1999 |
| JP | 2000-262449 | A | 9/2000 |
| JP | 2002-143060 | A | 5/2002 |
| JP | 2002-187336 | A | 7/2002 |
| JP | 2002-360474 | A | 12/2002 |
| JP | 2003-019097 | A | 1/2003 |
| JP | 2003-119575 | A | 4/2003 |
| JP | 2003-125995 | A | 5/2003 |
| JP | 2003-190056 | A | 7/2003 |
| JP | 2003-199695 | A | 7/2003 |
| JP | 2003-524522 | A | 8/2003 |
| JP | 2003-310502 | A | 11/2003 |
| JP | 2003-310506 | A | 11/2003 |
| JP | 2004-065357 | A | 3/2004 |
| JP | 2004-528087 | A | 9/2004 |
| JP | 2004-528876 | | 9/2004 |
| JP | 2005-034213 | A | 2/2005 |
| JP | 2005-324002 | | 11/2005 |
| JP | 2006-3119575 | U | 2/2006 |
| JP | 2006-061439 | A | 3/2006 |

(56) References Cited

FOREIGN PATENT DOCUMENTS

| | | | |
|---|---|---|---|
| JP | 2006-068500 | A | 3/2006 |
| JP | 2006-340972 | | 12/2006 |
| JP | 2007-007381 | A | 1/2007 |
| JP | 2008-073066 | A | 4/2008 |
| KR | 10-1993-0008369 | B1 | 8/1993 |
| KR | 10-1995-0016643 | | 7/1995 |
| KR | 10-1999-0050243 | | 7/1999 |
| KR | 10-1999-0055544 | | 7/1999 |
| KR | 20-2000-0011635 | | 7/2000 |
| KR | 10-2001-0081856 | | 8/2001 |
| KR | 10-2001-0087691 | | 9/2001 |
| KR | 10-2002-0012383 | | 2/2002 |
| KR | 10-2002-0091510 | A | 12/2002 |
| KR | 10-2003-0094869 | | 12/2003 |
| KR | 10-0437369 | | 6/2004 |
| KR | 10-2005-0005611 | A | 1/2005 |
| KR | 10-2005-0013694 | A | 2/2005 |
| KR | 10-2005-0025711 | | 3/2005 |
| KR | 10-2005-0040122 | | 5/2005 |
| KR | 10-2005-0108623 | | 11/2005 |
| KR | 10-2005-0109145 | | 11/2005 |
| KR | 10-0546629 | B1 | 1/2006 |
| KR | 10-0553042 | B1 | 2/2006 |
| KR | 10-2006-0031442 | A | 4/2006 |
| KR | 10-2006-0116992 | A | 11/2006 |
| KR | 10-0730956 | B1 | 6/2007 |
| KR | 10-2007-084834 | A | 8/2007 |
| KR | 10-2007-0088022 | A | 8/2007 |
| KR | 10-2007-0088023 | | 8/2007 |
| KR | 10-2007-0112324 | | 11/2007 |
| KR | 10-2007-0113353 | | 11/2007 |
| KR | 10-0800188 | B1 | 1/2008 |
| KR | 10-0800189 | B1 | 1/2008 |
| KR | 10-0838886 | B1 | 6/2008 |
| KR | 10-0838887 | B1 | 6/2008 |
| RU | 2 172 132 | C1 | 8/2001 |
| RU | 2 243 714 | C1 | 1/2005 |
| RU | 2 269 919 | C2 | 9/2005 |
| SU | 1326236 | A1 | 7/1987 |
| WO | WO 00/74548 | A1 | 12/2000 |
| WO | WO 01/35809 | A1 | 5/2001 |
| WO | WO 01/60524 | A1 | 8/2001 |
| WO | WO 0174493 | | 10/2001 |
| WO | WO 2004/064591 | A2 | 8/2004 |
| WO | WO 2005/099545 | A1 | 10/2005 |
| WO | WO 2008/114966 | | 9/2008 |

OTHER PUBLICATIONS

U.S. Office Action dated Nov. 3, 2010 issued in U.S. Appl. No. 12/710,585.
U.S. Final Office Action dated Nov. 8, 2010 issued in U.S. Appl. No. 12/406,803.
U.S. Office Action dated Nov. 12, 2010 issued in U.S. Appl. No. 12/704,933.
U.S. Office Action issued in U.S. Appl. No. 12/407,243 dated Nov. 16, 2011.
U.S. Office Action issued in U.S. Appl. No. 12/404,692 dated Dec. 7, 2011.
U.S. Office Action issued in U.S. Appl. No. 12/404,715 dated Dec. 8, 2011.
U.S. Notice of Allowance issued in U.S. Appl. No. 12/710,585 dated Dec. 30, 2011.
U.S. Office Action issued in U.S. Appl. No. 12/407,975 dated Jan. 30, 2012.
Japanese Office Action dated Jan. 4, 2011. (Application No. 2006-333685).
Korean Office Action dated Mar. 25, 2008 issued in Application No. 10-2007-0007359 (016285635).
Korean Office Action dated Sep. 30, 2008 issued in Application No. 10-2007-007359 (050567614).
Japanese Office, Action dated Mar. 13, 2009 issued in Application No. 2007-021083.
Chinese Office Action dated Jul. 3, 2009 issued in Application No. 200610168848.0 (with translation).
Japanese Office Action dated Aug. 3, 2010 issued in Application No. 2006-333685 (2009-11705).
Chinese Office Action dated Oct. 27, 2010 issued in Application No. 200610168848.0 (with English translation).
Chinese Office Action dated Nov. 9, 2010 issued in Application No. 200610169333.2 with English translation).
U.S. Office Action issued in U.S. Appl. No. 12/407,243, dated Sep. 19, 2012.
U.S. Office Action issued in U.S. Appl. No. 12/704,915, dated Dec. 10, 2012.
U.S. Office Action issued in U.S. Appl. No. 12/704,901, dated Mar. 25, 2013.
U.S. Notice of Allowance issued in U.S. Appl. No. 12/407,243, dated Jun. 6, 2013.
U.S. Office Action issued in U.S. Appl. No. 12/704,901 dated Oct. 3, 2013.
Korean Notice of Allowance dated Feb. 25, 2013 (012747359).
Korean Notice of Allowance dated Feb. 25, 2013 (012747214).
Korean Notice of Allowance dated Feb. 25, 2013 (012747168).
Korean Notice of Allowance dated Jun. 5, 2013 (039303446).
U.S. Office Action issued in U.S. Appl. No. 12/406,779 dated Feb. 3, 2011.
U.S. Office Action issued in U.S. Appl. No. 11/831,473 dated Feb. 4, 2011.
U.S. Office Action issued in U.S. Appl. No. 12/408,066 dated Feb. 10, 2011.
U.S. Office Action issued in U.S. Appl. No. 12/710,585 dated Feb. 10, 2011.
U.S. Office Action issued in U.S. Appl. No. 12/404,739 dated Feb. 18, 2011.
U.S. Office Action issued in U.S. Appl. No. 12/404,692 dated Mar. 9, 2011.
U.S. Office Action issued in U.S. Appl. No. 12/404,715 dated Mar. 9, 2011.
U.S. Notice of Allowance issued in U.S. Appl. No. 12/408,066 dated Mar. 21, 2011.
U.S. Notice of Allowance issued in U.S. Appl. No. 12/407,224 dated Mar. 28, 2011.
Japanese Office Action dated Jan. 4, 2011. (Application No. 2006-333685)
European Search Report dated Jan. 27, 2011. (Application No. 06125798.6-2316/1852048).
Russian Office Action dated Feb. 2, 2011 (Application No. 2009143355) (with translation).
Korean Notice of Allowance dated Aug. 28, 2008. (KR10-2006-0018119).
Korean Notice of Allowance dated Aug. 28, 2008. (KR10-2006-0046077).
Korean Office Action dated Aug. 29, 2008. (KR10-2006-0085919).
Korean Notice of Allowance dated Sep. 26, 2008. (KR10-2006-0085921).
Korean Notice of Allowance dated Feb. 16, 2009. (KR10-2006-0045415).
Korean Notice of Allowance dated Apr. 28, 2009. (KR10-2006-0045416).
European Search Report dated Mar. 19, 2012.
U.S. Office Action issued in U.S. Appl. No. 12/407,243 dated Apr. 6, 2012.
U.S. Notice of Allowance issued in U.S. Appl. No. 12/404,715 dated Apr. 26, 2012.
Japanese Office Action dated Apr. 7, 2011. (2010-005365).
U.S. Office Action issued in U.S. Appl. No. 12/407,983 dated Jun. 21, 2011.
U.S. Notice of Allowance issued in U.S. Appl. No. 12/407,293 dated Jun. 29, 2011.
U.S. Office Action issued in U.S. Appl. No. 12/407,243 dated Jul. 18, 2011.
U.S. Office Action issued in U.S. Appl. No. 12/404,692 dated Jul. 20, 2011.
U.S. Office Action issued in U.S. Appl. No. 12/404,715 dated Jul. 22, 2011.

(56) References Cited

OTHER PUBLICATIONS

U.S. Office Action issued in U.S. Appl. No. 12/407,975 dated Jul. 28, 2011.
Russian Office Action dated Sep. 28, 2007 issued in Application No. 2007103559 (translation only).
Russian Office Action dated Oct. 1, 2007 issued in Application No. 2007103555 (translation).
Russian Office Action dated Oct. 10, 2007 issued in Application No. 2007103557.
U.S. Office Action dated Feb. 11, 2008 issued in U.S. Appl. No. 11/831,473.
U.S. Office Action dated Feb. 11, 2008 issued in U.S. Appl. No. 11/831,564.
Korean Office Action dated Mar. 25, 2008 issued in Application No. 10-2007-0007359.
Australian Office Action dated Apr. 15, 2008 issued in Application No. 2007200407.
Australian Office Action dated Apr. 17, 2008 issued in Application No. 2007200408.
Russian Office Action dated Apr. 21, 2008 issued in Application No. 2007103560 (with translation).
Australian Office Action dated Apr. 24, 2008 issued in Application No. 2007200409.
European Office Action dated May 8, 2008 issued in Application No. 07 101 388.2-2316.
Australian Office Action dated Jun. 3, 2008 issued in Application No. 2006249267.
U.S. Final Office Action dated Jul. 24, 2008 issued in U.S. Appl. No. 11/831,473.
U.S. Office Action dated Jul. 28, 2008 issued in U.S. Appl. No. 11/712,958.
U.S. Office Action dated Aug. 28, 2008 issued in U.S. Appl. No. 11/713,022.
Korean Office Action dated Aug. 29, 2008 issued in Application No. 10-2006-0045415.
Japanese Office Action dated Sep. 18, 2008 issued in Application No. 2006-332005.
U.S. Office Action dated Sep. 19, 2008 issued in U.S. Appl. No. 11/831,564.
Korean Office Action dated Sep. 30, 2008 issued in Application No. 10-2007-007359.
U.S. Office Action dated Oct. 20, 2008 issued in U.S. Appl. No. 11/831,473.
Japanese Office Action dated Nov. 6, 2008 issued in Application No. 2006-333685.
International Search Report and Written Opinion dated Dec. 10, 2008 issued in Application No. PCT/KR2008/004849.
Chinese Office Action dated Dec. 12, 2008 issued in Application No. 200710002992.1 (translation).
Japanese Office Action dated Dec. 24, 2008 issued in Application No. 2006-333719.
Chinese Office Action dated Feb. 6, 2009 issued in Application No. 200710085701X.
U.S. Final Office Action dated Mar. 9, 2009 issued in U.S. Appl. No. 11/713,022.
Japanese Office Action dated Mar. 12, 2009 issued in Application No. 2007-019770.
Japanese Office Action dated Mar. 12, 2009 issued in Application No. 2007-019861.
Japanese Office Action dated Mar. 13, 2009 issued in Application No. 2007-021083.
Russian Office Action dated Mar. 25, 2009 issued in Application No. 2008102660 (with translation).
Chinese Office Action dated Apr. 3, 2009 issued in Application No. 200710002990.2 (with translation).
Australian Office Action dated Apr. 16, 2009 issued in Application No. 2008200340.
Chinese Office Action dated May 8, 2009 issued in Application No. 200610153199.7 (translation).
U.S. Office Action dated May 13, 2009 issued in U.S. Appl. No. 11/965,133.
Chinese Office Action dated May 22, 2009 issued in Application No. 200710002292.1 (translation).
Japanese Office Action dated May 22, 2009 issued in Application No. 2006-333719.
U.S. Final Office Action dated May 28, 2009 issued in U.S. Appl. No. 11/831,473.
Chinese Office Action dated Jun. 5, 2009 issued in Application No. 200610169333.2 (translation).
European Search Report dated Jun. 16, 2009 issued in Application No. 06 12 5823 (in English).
Korean Office Action dated Jun. 19, 2009 issued in Application No. 10-2007-0071137.
Chinese Office Action dated Jul. 3, 2009 issued in Application. No. 200610168848.0 (with translation).
Japanese Office Action dated Jul. 28, 2009 issued in Application No. 2007-066748.
Chinese Office Action dated Aug. 21, 2009 issued in Application No. 200710002991.7 (with translation).
Chinese Office Action dated Aug. 21, 2009 issued in Application No. 200810008716.0 (with translation).
U.S. Office Action dated Sep. 3, 2009 issued in U.S. Appl. No. 11/831,564.
U.S. Office Action dated Sep. 10, 2009 issued in U.S. Appl. No. 11/565,241.
U.S. Office Action dated Oct. 6, 2009 issued in U.S. Appl. No. 12/406,803.
European Search Report dated Oct. 15, 2009 issued in Application No. 06 12 5560.0-2316.
Japanese Office Action dated Nov. 4, 2009 issued in Application No. 2007-019770 (with translation).
Chinese Office Action dated Nov. 13, 2009 issued in Application No. 200710085701.X (with translation).
Canadian Office Action dated Nov. 18, 2009 issued in Application No. 2,598,113.
Canadian Office Action dated Nov. 18, 2009 issued in Application No. 2,598,117.
Japanese Office Action dated Nov. 25, 2009 issued in Application No. 2007-019861.
Japanese Office Action dated Nov. 25, 2009 issued in Application No. 2007-021083.
Japanese Office Action dated Nov. 25, 2009 issued in Application No. 2007-066748.
Chinese Office Action dated Dec. 11, 2009 issued in Application No. 200710002992.1 (with translation).
U.S. Notice of Allowance dated Jan. 13, 2010 issued in U.S. Appl. No. 11/965,133.
European Search Report dated Jan. 20, 2010 issued in Application No. 06 12 5560.
Chinese Office Action dated Feb. 5, 2010 issued in Application No. 200710002991.7 (with translation).
U.S. Notice of Allowance dated Feb. 19, 2010 issued in U.S. Appl. No. 11/565,241.
U.S. Notice of Allowance dated Feb. 24, 2010 issued in U.S. Appl. No. 11/831,564.
Korean Office Action dated Mar. 18, 2010 issued in Application No. 10-2008-0065806.
Korean Office Action dated Mar. 25, 2010 issued in Application No. 10-2008-0065807.
U.S. Office Action dated Apr. 19, 2010 issued in U.S. Appl. No. 11/565,206.
U.S. Notice of Allowance dated Apr. 21, 2010 issued in U.S. Appl. No. 11/831,519.
Japanese Office Action dated May 13, 2010 issued in Application No. 2007-019861.
U.S. Office Action dated May 14, 2010 issued in U.S. Appl. No. 11/831,473.
U.S. Office Action dated May 26, 2010 issued in U.S. Appl. No. 12/406,803.
Canadian Office Action dated Jun. 30, 2010 issued in Application No. 2,598,113.

(56) References Cited

OTHER PUBLICATIONS

U.S. Office Action dated Jul. 9, 2010 issued in U.S. Appl. No. 11/965,133.
U.S. Office Action dated Jul. 23, 2010 issued in U.S. Appl. No. 12/408,066.
Japanese Office Action dated Aug. 3, 2010 issued in Application No. 2006-333685.
U.S. Office Action dated Aug. 18, 2010 issued in U.S. Appl. No. 12/406,779.
U.S. Office Action dated Sep. 1, 2010 issued in U.S. Appl. No. 11/831,473.
U.S. Notice of Allowance dated Oct. 1, 2010 issued in U.S. Appl. No. 11/565,206.
Russian Office Action dated Oct. 19, 2010 issued in Application No. 2009143355 (with English translation).
Chinese Office Action dated Oct. 27,2010 issued in Application No. 200610168848.0 (with English translation).
Chinese Office Action dated Nov. 9, 2010 issued in Application No. 200610169333.2 (with English translation).
U.S. Notice of Allowance dated Jan. 12, 2011 issued in U.S. Appl. No. 11/965,133.
U.S. Appl. No. 12/406,803, filed Mar. 18, 2009.
U.S. Appl. No. 12/704,901, filed Feb. 12, 2010.
U.S. Appl. No. 12/720,115, filed Mar. 9, 2010.
U.S. Office Action issued in U.S. Appl. No. 12/704,901 dated Jan. 29, 2014.

* cited by examiner

VACUUM CLEANER

This application claims priority to U.S. Provisional Application No. 61/160,048, filed Mar. 13, 2009, which is hereby incorporated by reference.

BACKGROUND

1. Field

A vacuum cleaner is disclosed herein.

2. Background

Vacuum cleaners are known. However, they suffer from various disadvantages.

BRIEF DESCRIPTION OF THE DRAWINGS

Embodiments will be described in detail with reference to the following drawings in which like reference numerals refer to like elements, and wherein.

DETAILED DESCRIPTION

Figure 1:
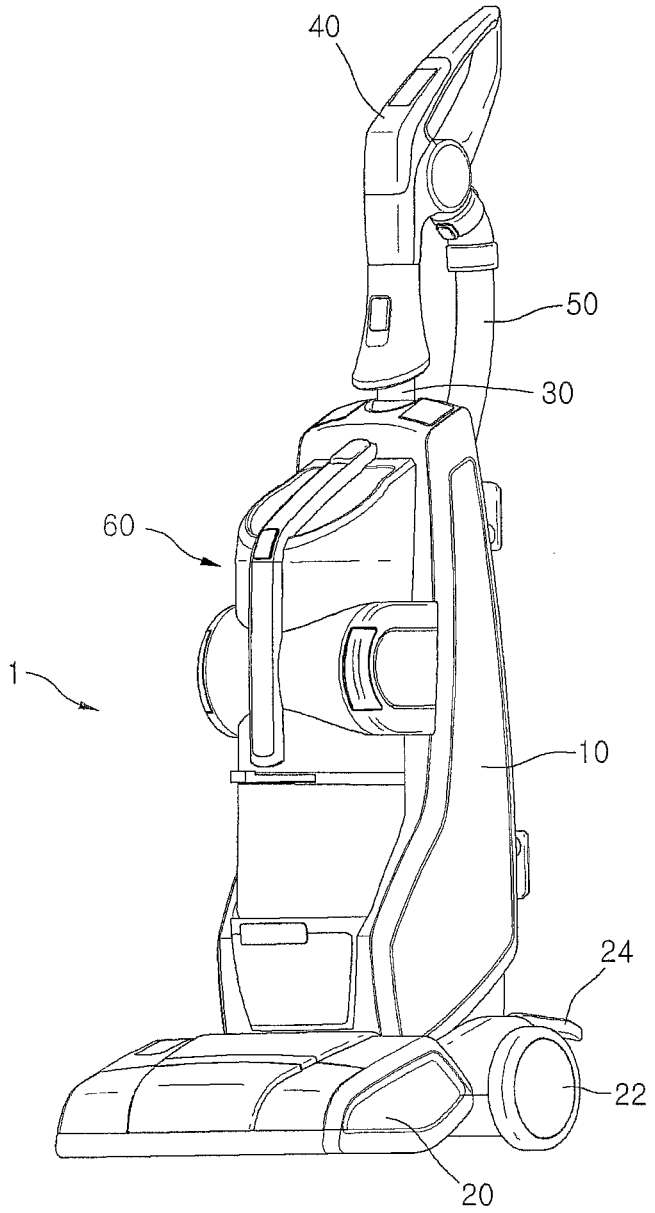
FIG. 1 is a front perspective view of a vacuum cleaner according to an embodiment.

Reference will now be made in detail to the embodiments, examples of which are illustrated in the accompanying drawings. Where possible, like reference numerals have been used to indicate like elements.

In the following detailed description of embodiments, reference is made to the accompanying drawings that form a part hereof, and in which is shown by way of illustration embodiments in which the invention may be practiced. These embodiments are described in sufficient detail to enable those skilled in the art to practice the invention, and it is understood that other embodiments may be utilized and that logical structural, mechanical, electrical, and mechanical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the invention is defined only by the appended claims.

In general, a vacuum cleaner is an apparatus that filters dust in a dust separating device after sucking the air including the dust using suction power generated by a suction motor mounted in a main body. The vacuum cleaner may include the main body with the suction motor disposed therein, the dust separating device that separates dust from the sucked air, and a dust storage device that stores dust separated by the dust separating device.

Figure 2:
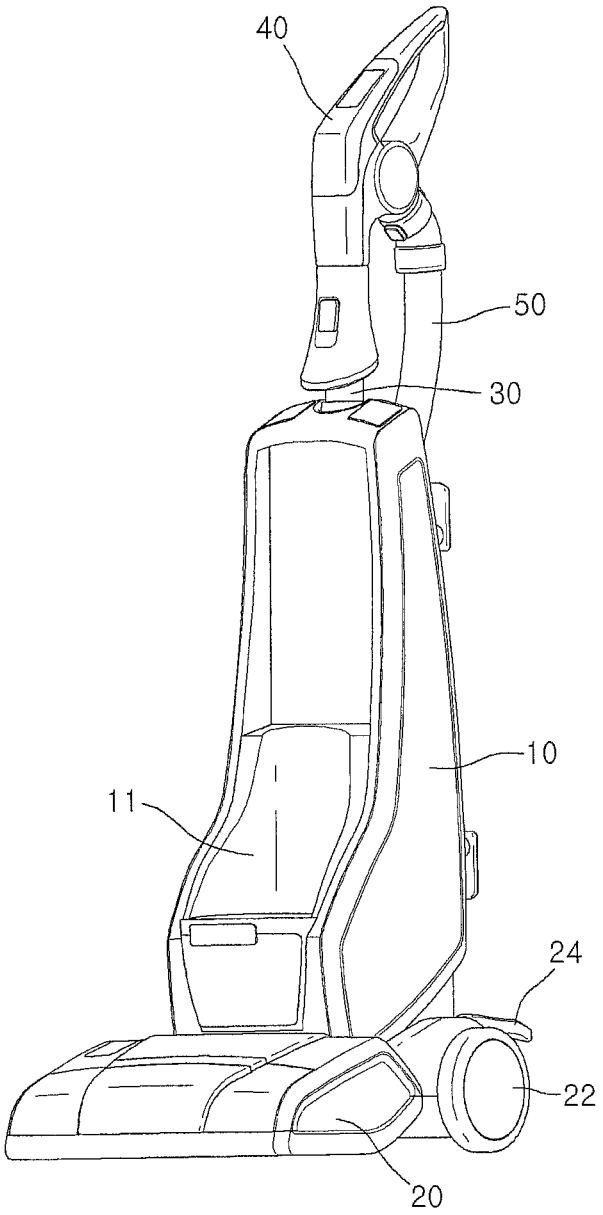
FIG. 2 is a front perspective view of the vacuum cleaner of FIG. 1 showing a dust separator separated therefrom.

FIG. 1 is a front perspective view of a vacuum cleaner according to an embodiment. FIG. 2 is a front perspective view of the vacuum cleaner of FIG. 1 from which a dust separator is separated. In FIG. 1, as an example of a vacuum cleaner, an upright-type vacuum cleaner is shown; however, embodiments are not limited thereto. That is, embodiments may be applied to other types of vacuum cleaners as well, such as a canister-type vacuum cleaner or a robot cleaner.

Referring to FIGS. 1 and 2, the vacuum cleaner 1 according to this embodiment may include a main body 10 having a suction motor (not shown) that generates a sucking power, a suction nozzle 20, which may be rotatably connected at a lower part of the main body 10 and configured to suck dust from a surface or floor, a dust separator 60, which may be removably mounted on the main body 10, a suction tube 30, which may be removably mounted on the main body 10, a handle 40 connected to the suction tube 30, and a connection hose 50, which may connect the main body 10 with the handle 40. A wheel that facilitates movement of the suction nozzle 20 may be provided at both sides of the suction nozzle 20. An operation lever 24 may be provided to rotate the suction nozzle 20 with respect to the main body 10 standing upright at a backside of the suction nozzle 20.

The dust separator 60 may be removably mounted on a mounting portion 11, which may be formed in a front part of the main body 10, and the suction tube 30 may be removably provided in or at a rear part of the main body 10. The dust separator 60 may separate dust from air sucked into the main body 10 and store the separated dust.

Figure 3:
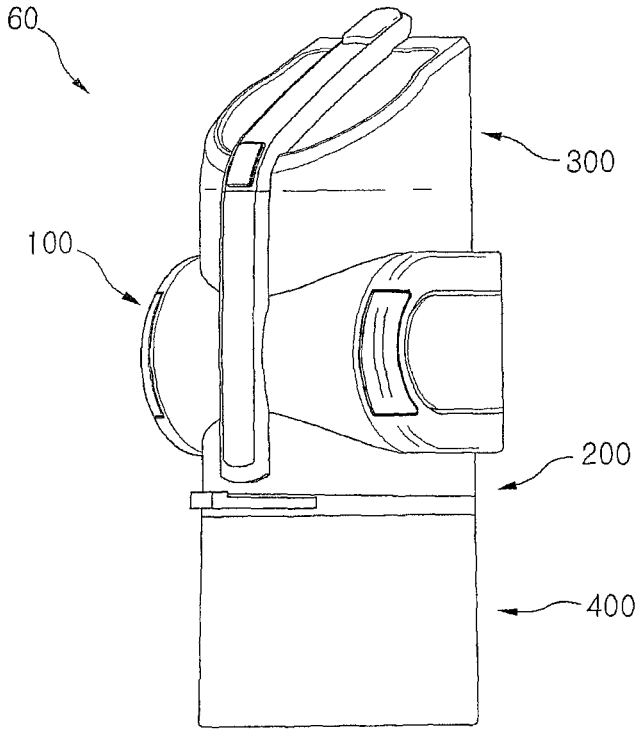
FIG. 3 is a perspective view of the dust separator according to the embodiment of FIG. 1.
Figure 4:
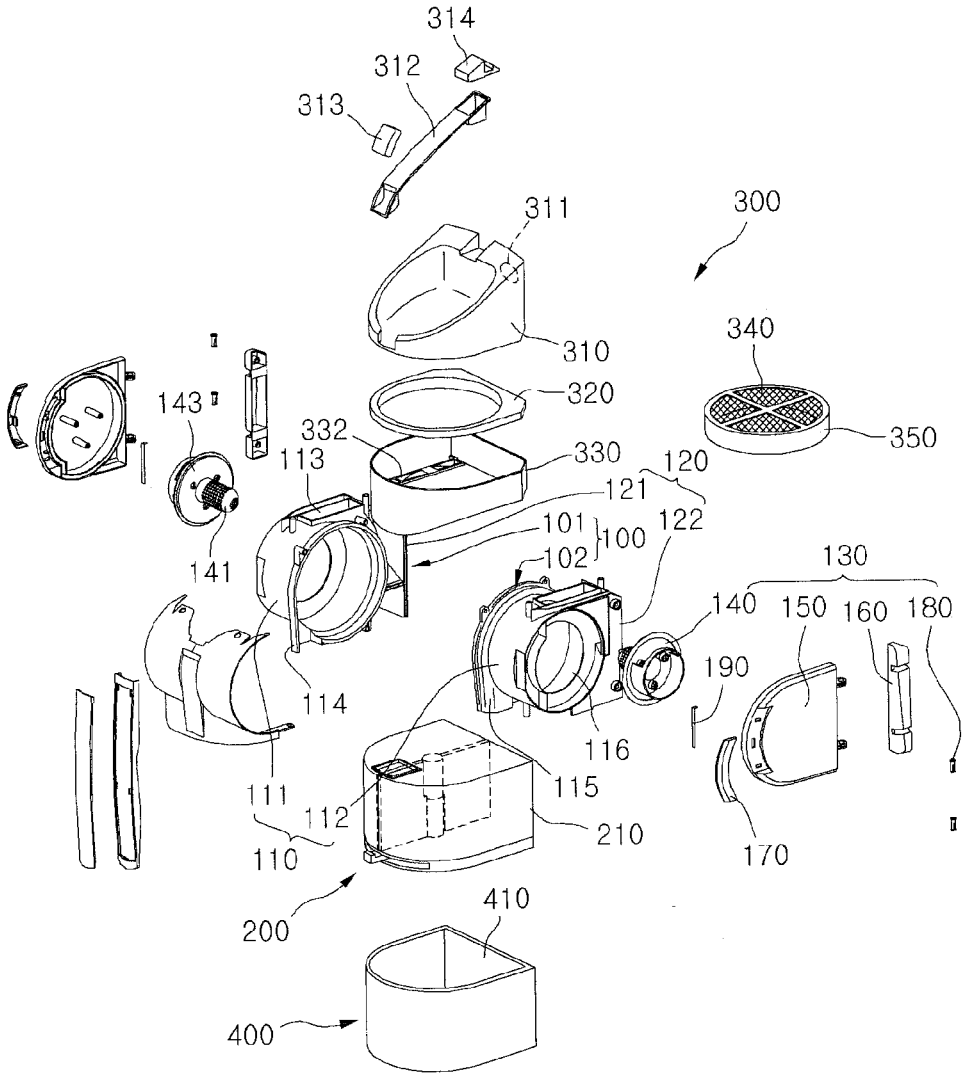
FIG. 4 is an exploded perspective view of the dust separator according to the embodiment of FIG. 1.

FIG. 3 is a perspective view of the dust separator according to the embodiment of FIG. 1. FIG. 4 is an exploded perspective view of a dust separator according to the embodiment of FIG. 1. Referring to FIGS. 3 and 4, the dust separator 60 according to this embodiment may include a dust separation device 100 that separates dust from sucked in air, a compression device 200 that compresses the dust separated by the dust separation device 100, a discharge guide device 300 that guides flow of discharged air from the dust separation device 100, and a dust storage device 400 that receives the dust compressed by the compression device 200 and stores the compressed dust. In addition, the dust separation device 100 may be coupled to an upper part of the compression device 200 and a lower part of the discharge guide device 300.

The dust storage device 400 may be removably coupled to a lower part of the compression device 200. The dust storage device 400 may be coupled to the compression device 200, for example, by a hook mechanism; however, embodiments are not limited thereto.

A deco cover 360 may be coupled to the dust separation device 100. Further, in a state in which the compression device 200 and the dust separation device 100 are coupled to each other, an inner deco 370 and an outer deco 380 may be coupled to the deco cover 360 and the compression device 200. The deco cover 360, the inner deco 370, and the outer deco 380 may improve aesthetics of the dust separator 60.

The dust separation device 100 may include a cyclone device 110 that separates dust from air, a distribution device 120 that guides air, light, and dust to the cyclone device 110, and a plurality of filter devices 130 rotatably coupled to the cyclone device 110. More specifically, the dust separation device 100 may include a first dust separation body 101 and a second dust separation body 102, which may be coupled to each other. The first dust separation body 101 may include a first cyclone body 111 that generates a first cyclone flow and a first distribution body 121, which may be formed integrally with the first cyclone body 111, that guides air to the first cyclone body 111. The second dust separation body 102 may include a second cyclone body 112 that generates a second cyclone flow and a second distribution body 122, which may be formed integrally with the second cyclone body 112, that guides air to the second cyclone body 112.

The first cyclone body 111 and the second cyclone body 112 may form the cyclone device 110 and the first distribution body 121 and the second distribution body 122 may form the distribution device 120. Each of the cyclone bodies 111 and 112 may include an air suction portion 113. Therefore, a plurality of air suction portions 113 may be formed in the cyclone device 110.

A first dust discharge portion 114 may be integrally formed in the first cyclone body 111, and a second dust discharge portion 115 may be integrally formed in the second cyclone body 112. Further, when the first cyclone body 111 and the second cyclone body 112 are coupled to each other, the first dust discharge portion 114 and the second dust discharge portion 115 may be coupled to each other to form a single dust discharge portion.

Each of the filter devices 130 may include a filter member 140 inserted into an inside of the cyclone device 110 from outside of the cyclone device 110, a cover member 150 coupled with the filter member 140, a cover coupler 160 coupled with the cover member 150 to rotatably support the cover member 150, a coupling member 170 operated to rotate the cover member 150 by being coupled with the cover member 150, an elastic member 190 that elastically supports the coupling member 170, and a shaft 180 adapted to rotatably connect the cover member 150 to the cover coupler 160. The cover coupler 160 may be coupled to the distribution device 120. Alternatively, the cover coupler 160 may be integrally coupled to the distribution device 120.

The filter member 140 may include a filter body 141 and an opening cover 143 that extends from an outer peripheral surface of the filter body 141. The filter body 141 may selectively penetrate an exhaust opening 116 formed in the cyclone device 110, and the opening cover 143 may selectively open and close the exhaust opening 116.

The discharge guide device 300 may include an exhaust member 330 coupled to an upper part of the dust separation device 100, an exhaust filter 340 seated on the exhaust member 330 that filters exhausted air, a filter housing 350 that protects the exhaust filter 340, a filter seating guide 320 coupled to the exhaust member 330 and configured to guide seating of the filter housing 350 coupled with or to the exhaust filter 340, and an upper cover 310 rotatably coupled to an upper part of the exhaust member 330.

An air discharge hole 311 that discharges air may be formed in the upper cover 310. The air passing through the air discharge hole 311 may move to the main body 10.

A handle portion 312 that facilitates a user gripping the dust separator 60 may be coupled to the upper cover 310. The handle portion 312 may include a first coupling button 313 that fixes a position of the upper cover 310 and a second coupling button 314 that couples the dust separator 60 to the main body 10. The first coupling button 313 may be selectively coupled with or to the inner deco 370.

In addition, an exhaust passage 332, through which air discharged from the dust separation device 100 may flow, may be formed in the exhaust member 330. The air discharged to the exhaust passage 332 may pass through the exhaust filter 340, and then, may be discharged through the air discharge hole 311.

The dust separated by the dust separation device 100 may be introduced into the compression device 200. The introduced dust may be compressed in an inside of the compression device 200 and selectively discharged to the dust storage device 400.

The dust compressed by the compression device 200 may be introduced into the dust storage device 400. A dust storage potion 410 that stores the compressed dust may be formed in the dust storage device 400. That is, in this embodiment, only the dust storage portion 410 that stores the compressed dust may be formed in the dust storage device 400, such that the structure of the dust storage device 400 may be simplified. Further, as a user may discharge dust by separating only the dust storage device 400 from the compression device 200, the structure of the dust storage device 400 may be light-weight and the dust storage device 400 easy to handle.

Hereinafter, the structure of a compression device according to an embodiment will be described in more detail.

Figure 5:
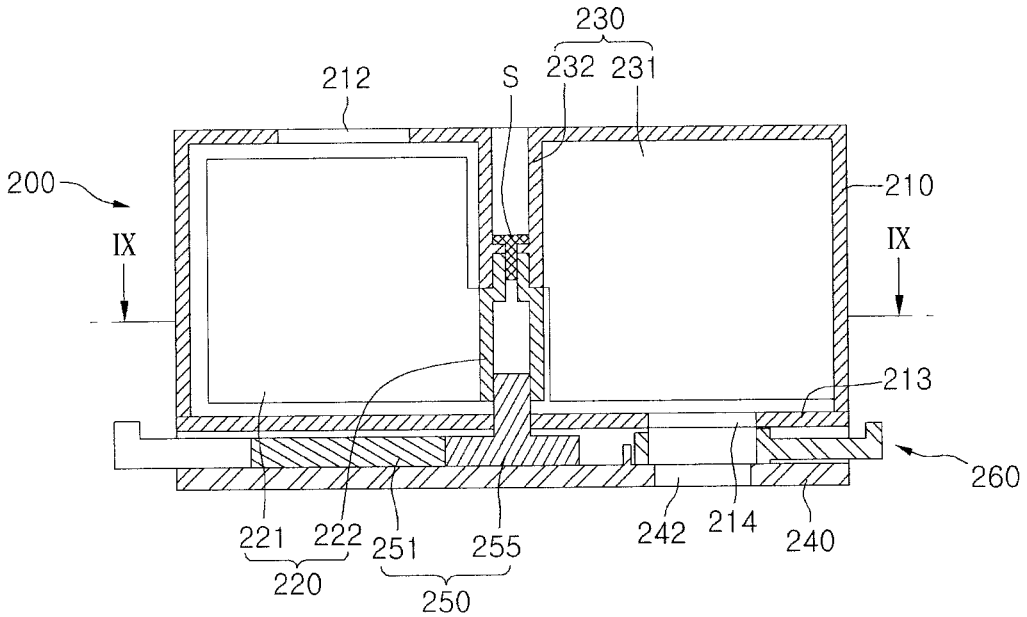
FIG. 5 is a vertical cross-sectional view of a compression device according to the embodiment of FIG. 1.
Figure 6:
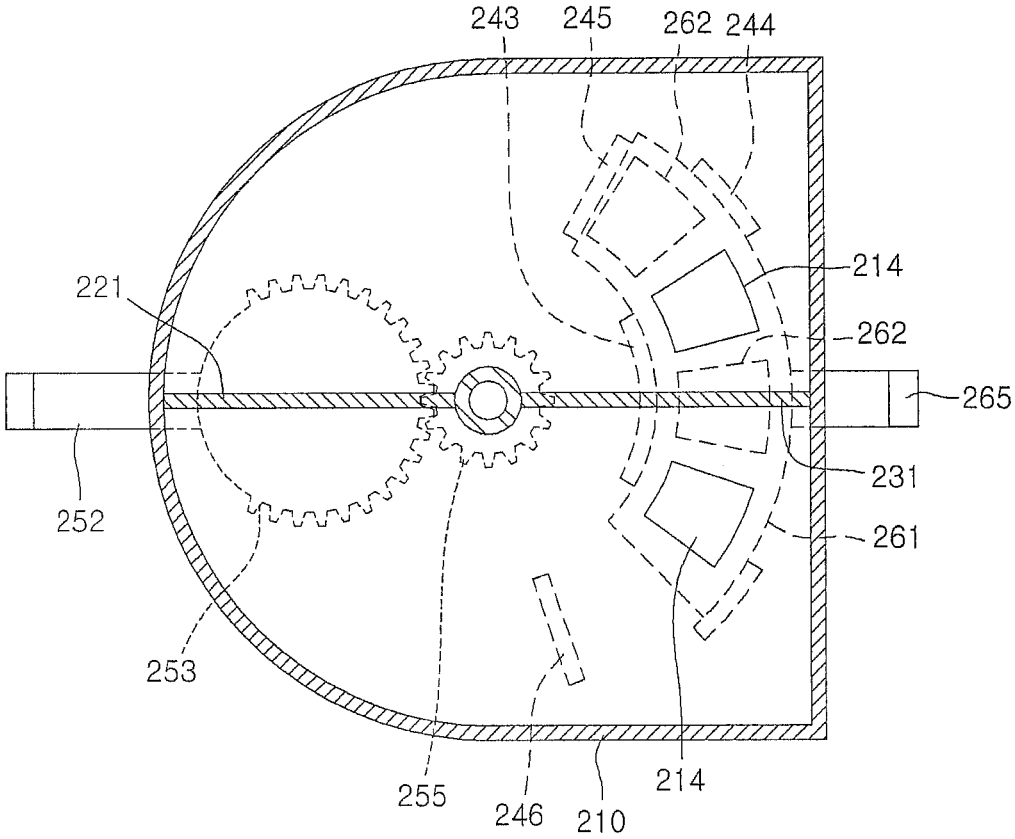
FIG. 6 is a cross-sectional view taken along line VI-VI of FIG. 5.
Figure 7:
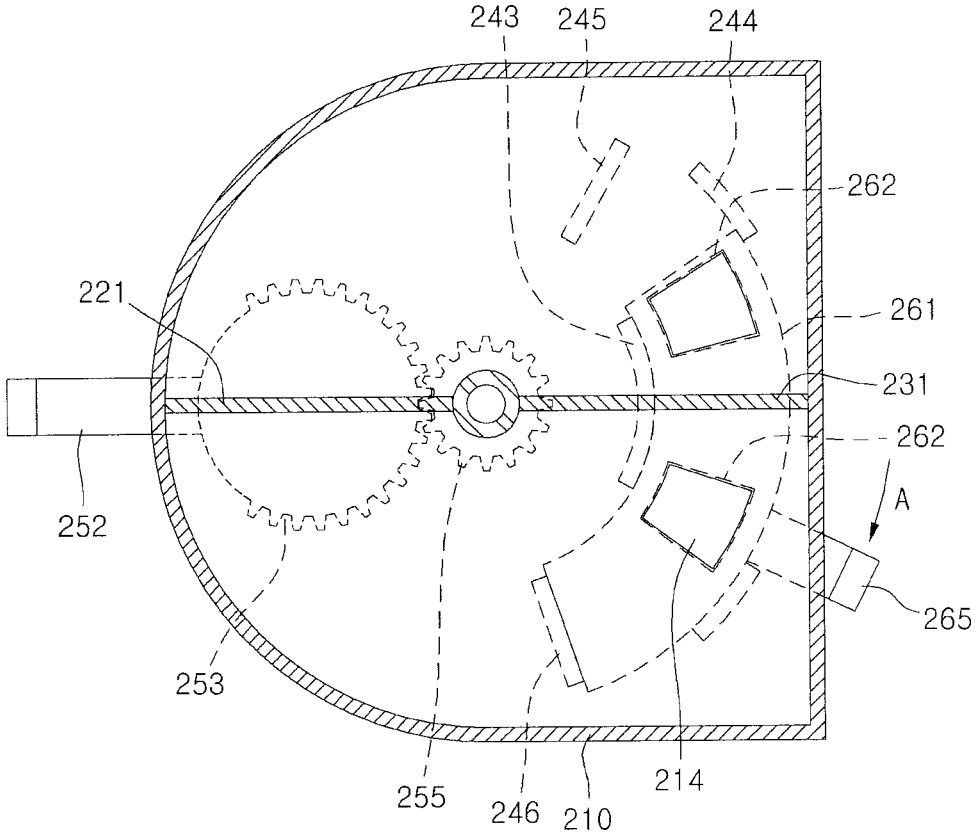
FIG. 7 is a cross-sectional view taken along line VI-VI of FIG. 5 in a state in which communication between a compression device and a dust container may be controlled by an opening and closing device.

FIG. 5 is a vertical cross-sectional view of a compression device according to the embodiment of FIG. 1. FIG. 6 is a cross-sectional view taken along VI-VI of FIG. 5. FIG. 7 is a cross-sectional view taken along line VI-VI of FIG. 5 in a state in which communication between a compression device and a dust container may be controlled by an opening and closing device.

Referring to FIGS. 3 to 7, the compression device 200 according to this embodiment may include a compression body 210 that forms a compression space, a plurality of compression members 220 and 230 that compress the dust introduced into the compression body 210, a drive device 250 that drives at least one of the plurality of compression members 220 and 230, and an opening and closing device 260 that allows selective communication between the compression body 210 and the dust storage device 400. More specifically, a dust introduction portion 212, into which the dust discharged from the dust separation device 100 may be introduced, may be formed on an upper part of the compression body 210. A lower part of the compression body 210 may be open. A lower opening of the compression body 210 may be covered by a lower wall 213. The lower wall 213 may form a bottom surface of the compression body 210. In addition, one or more discharge holes 214 that discharge the compressed dust may be formed on or in the lower wall 213.

The plurality of compression members 220 and 230 may include a first compression member 220, which may be rotatably provided in the compression body 210, and a second compression member 230, which may be fixed in the compression body 210 and compress dust by interaction with the first compression member 220. The first compression member 220 may be bidirectionally rotated by the drive device 250. In addition, the compressed dust may be stored at both sides of the second compression member 230.

The first compression member 220 may include a first compression plate 221 and a rotational shaft 222, which may be coupled or integrally formed with the first compression plate 221. The second compression member 230 may include a second compression plate 231 that interacts with the first compression plate 221 and a fixed shaft 232, which may be coupled with the rotational shaft 222. The fixed shaft 232 may be integrally formed on an internal upper part of the compression body 210 or an upper part of a lower wall 213.

In addition, the fixed shaft 232 may extend from a lower part to an upper part of the compression body 210. The second compression 231 may be integrally formed with the compression body 210 or the lower wall 213. The second compression plate 231 may be formed with at least one of an inner peripheral surface of the compression body 210, an upper part of the compression body 210, or the fixed shaft 232. The rotational shaft 222 may be inserted into the fixed shaft 232 from a lower part of the fixed shaft 232. In addition, when the rotational shaft 222 is inserted into the fixed shaft 232, a connection member S may be connected to the fixed shaft 232 and the rotational shaft 222 from an upper part of the compression device 200. Since the rotational shaft 222 rotates while being inserted into the fixed shaft 232, the rotational shaft 222 may be guided to rotate by the fixed shaft 232.

The drive device 250 may include an operation device 251 that generates a driving force and a transmission portion 255 that transmits an operation force of the operation device 251 to the first compression member 220. The operation device 251 may be provided below the lower wall 213. The operation device 251 may include an operation portion 252 for a user's operation and a connection portion 253, which may be formed integrally with the operation portion 252 and connected with the transmission portion 255. The connection portion 253 and the transmission portion 255 may be a gear, for example.

A plurality of gear teeth may be formed on a periphery of each of the connection portion 253 and the transmission portion 255. When the connection portion 253 rotates at a first angle, a diameter of the connection portion 253 may be formed to be larger than a diameter of the transmission portion 255 so that the transmission portion 255 rotates at a second angle larger than the first angle. The transmission portion 255 may be coupled to the rotational shaft 222 while penetrating the lower wall 213 to extend below the lower wall 213.

The opening and closing device 260 may include an operation portion 265 for a user's operation and an opening and closing member 261 that opens and closes the discharge hole 214 by operation of the operation portion 265. More specifically, a plurality of discharge holes 214 may be formed on the lower wall 213. The embodiment of FIG. 6 shows two discharge holes 214. One of the discharge holes 214 may be positioned adjacent to one side of the second compression plate 231 and the other discharge hole 214 may be positioned adjacent to the other side of the second compression plate 231. Therefore, the compressed dust accumulated at or on both sides of the second compression plate 231 may be discharged to the outside through the discharge holes 214 at both sides of the second compression plate 231.

The opening and closing member 261 may be rotatably provided below the lower wall 213. A virtual rotational center of the opening and closing member 261 may coincide with a rotational center of the rotational shaft 222. Two communication holes 262, which may be selectively allowed to communicate with the two discharge holes 214, may be formed in the opening and closing member 261. The two communication holes 262 may define a dust discharge passage. A gap between the two communication holes 262 may be a same size as a gap between the two discharge holes 214.

In addition, the drive device 250 and the opening and closing device 260 may be covered by a lower cover 240. Two opening portions 242 may be formed at positions corresponding to the two discharge holes 214 in the lower cover 240.

Therefore, as shown in FIG. 6, in a state in which the communication hole(s) 262 of the opening and closing member 261 are not aligned with the discharge hole(s) 214 of the lower wall 213, the opening and closing member 261 may close the discharge hole(s) 214. In this state, the compressed dust may be accumulated on an upper part of the lower wall 213 and an upper part of the opening and closing member 261 at both sides of the second compression plate 231. On the other hand, as shown in FIG. 7, when the opening and closing member 261 is rotated in a clockwise direction (arrow A in FIG. 7) by using the operation portion 265, the discharge hole(s) 214 and the communication hole(s) 262 and the opening portion(s) 242 may be aligned. Then, the dust accumulated at both sides of the second compression plate 231 may pass through the discharge hole(s) 214, the communication hole(s) 262, and the opening portion(s) 242 in sequence to be discharged outside of the compression device 200.

Guide ribs 243 and 244 that guides movement of the opening and closing member 261 may be formed in or on the lower cover 240. Further, the lower cover 240 may include a first stopper 245 that functions as a stop position when the opening and closing member 261 rotates in a direction to close the discharge hole(s) 214 and a second stopper 246 that functions as a stop position when the opening and closing member 261 rotates in a direction to open the discharge hole(s) 214.

According to this embodiment, the dust separated by the dust separation device 100 may be first stored in the compression device 200. The dust stored in the compression device 200 may be compressed by the plurality of compression members 220 and 230. Then, the dust may be stored in a compressed state in the compression device 200.

The dust stored in the compression device 200 may be compressed when the dust separator 60 is mounted on or separated from the main body 10. In addition, when the dust separator 60 is to be separated from the main body 10, the compressed dust stored in the compression device 200 may drop into the dust storage device 400 by operating the opening and closing device 260.

As the compressed dust may be dropped and stored in the dust storage device 400, a size of the dust storage device 400 may be reduced. Further, as the compressed dust may be discharged outside of the dust storage device 400, scattering of dust may be reduced when the compressed dust stored in the dust storage device 400 is discharged. As the compressed dust may be stored in the compression device 200, the compression device 200 may be referred to as a first storage device and the dust storage device 400 may be referred to as a second storage device.

Figure 8:
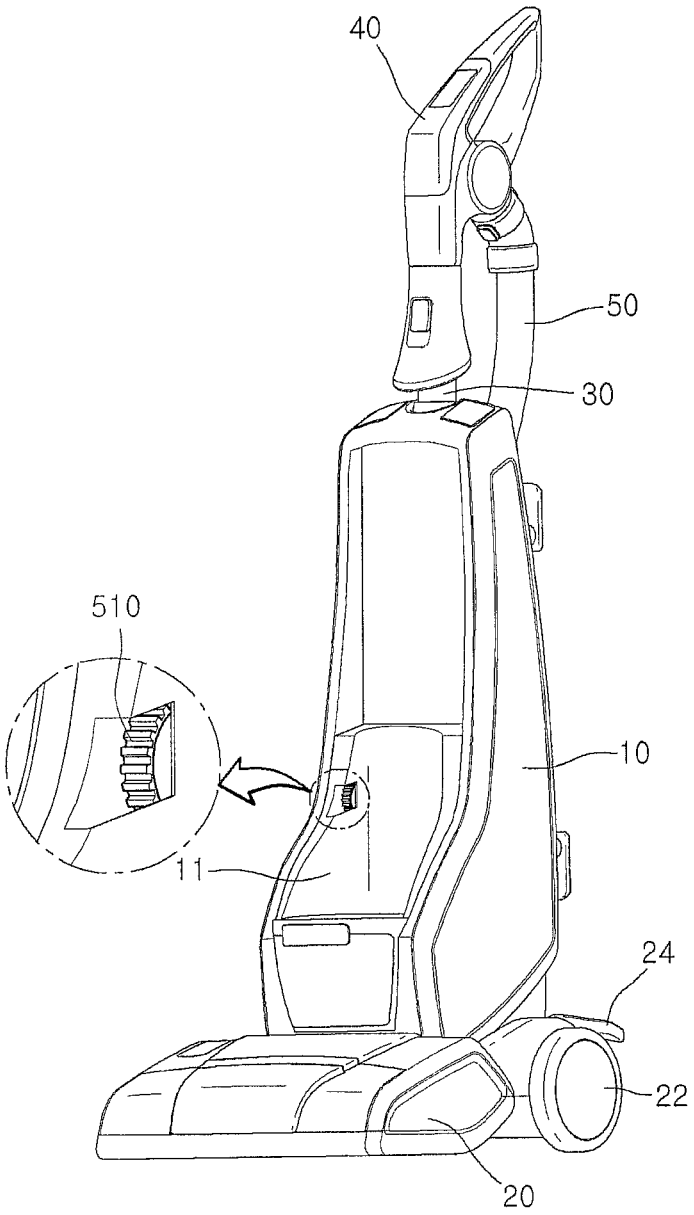
FIG. 8 is a perspective view of a vacuum cleaner from which a dust separator is separated according to another embodiment.
Figure 9:
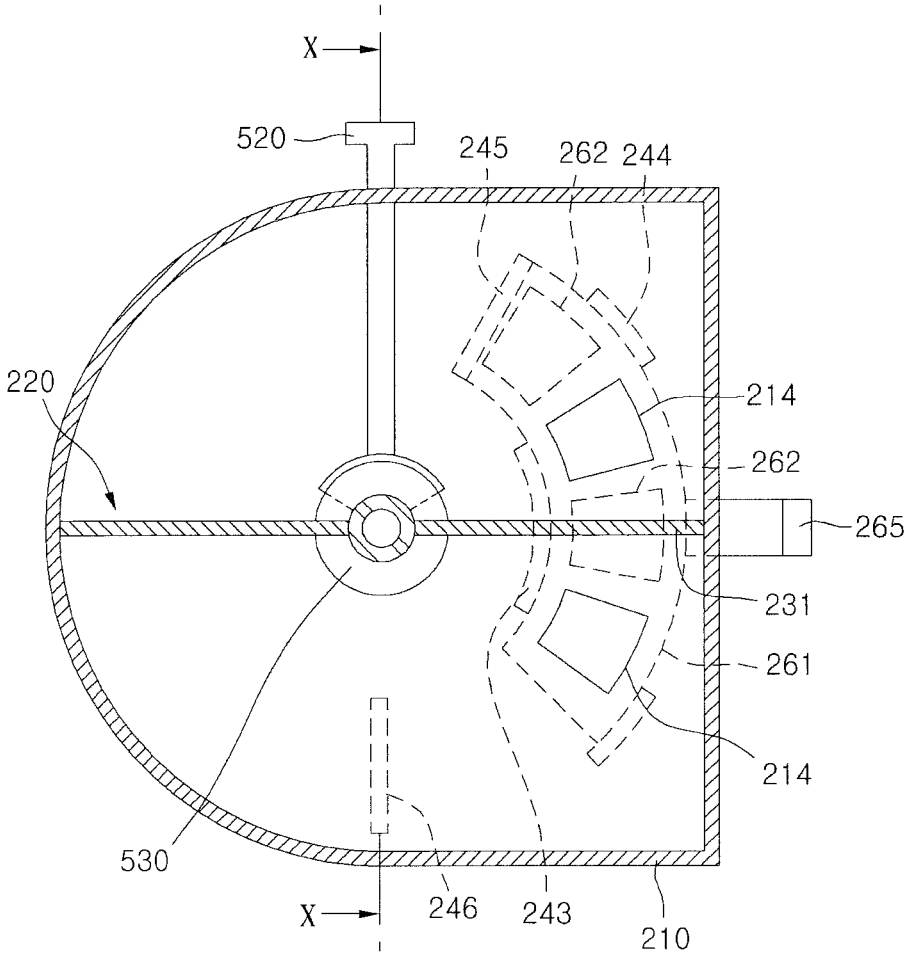
FIG. 9 is a cross-sectional view taken along line VI-VI of FIG. 5 according to the embodiment of FIG. 8.
Figure 10:
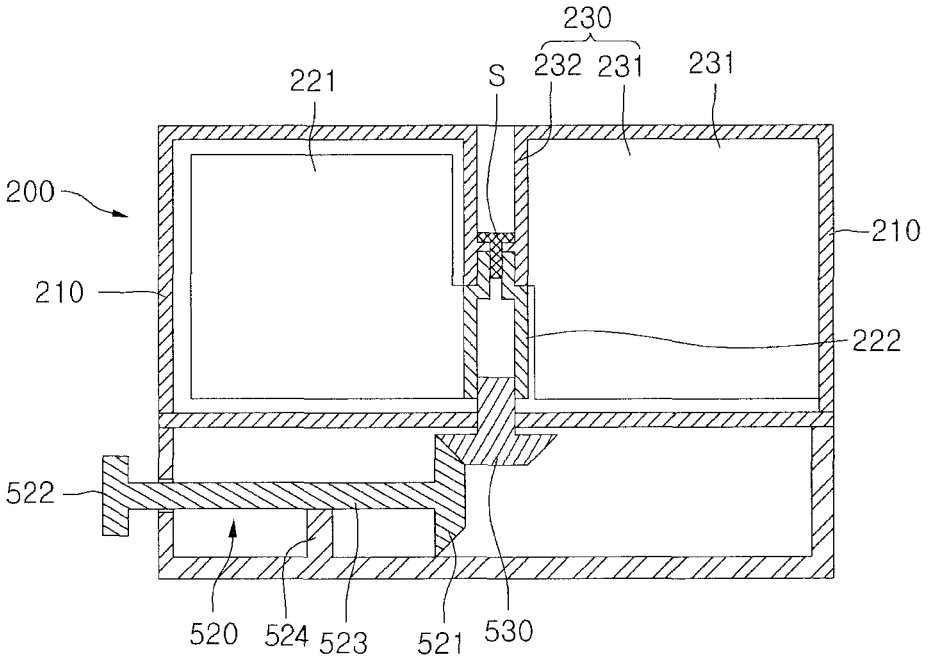
FIG. 10 is a cross-sectional view taken along line X-X of FIG. 9.

FIG. 8 is a perspective view of a vacuum cleaner from which a dust separator is separated according to another embodiment. FIG. 9 is a cross-sectional view taken along line IX-IX of FIG. 5 according to the embodiment of FIG. 8. FIG. 10 is a cross-sectional view taken along line X-X of FIG. 9. This embodiment is the same as the embodiment of FIG. 1 except for a driving scheme of the compression member. Therefore, repetitive disclosure has been omitted.

Referring to FIGS. 8 to 10, the first compression member 220 may be automatically rotated by the drive device. The drive device may include a compression motor (not shown) provided in the main body 10 and a power transmission portion that transmits power of the compression motor to the first compression member 220. The power transmission portion may include a first transmission portion 510 connected to the compression motor, a second transmission portion 520, which may be selectively connected with the first transmission portion 510, and a third transmission portion 530, which may be connected with the second transmission portion 520 and coupled to the rotational shaft 222 of the first compression member 220.

A bidirectionally rotatable motor may be used as the compression motor, for example. For example, a synchronous motor may be used as the compression motor. The first transmission portion 510 may be exposed to the outside of the mounting portion 11 while being connected to the compression motor. The first transmission portion 510 may be, for example, a gear. The second transmission portion 520 and the third transmission portion 530 may be bevel gears, for example. The second transmission portion 520 may include an external gear 522, which may be selectively connected with the first transmission portion 510 and positioned outside of the compression device 200, and an internal gear 521, which may be connected with the third transmission portion 530 and positioned below the lower wall 213 of the compression body 210. The external gear 522 and the internal gear 521 may be connected by a connection shaft 523.

The connection shaft 523 may be supported by a supporter 524. Therefore, when the dust separation device is mounted on the main body 10, the second transmission portion 520 may be connected with the first transmission portion 510, such that the first compression member 220 is rotatable by the compression motor. According to this embodiment, as the first compression member 220 may be automatically rotated, a problem that the first compression member 220 must be rotated is removed.

Figure 11:
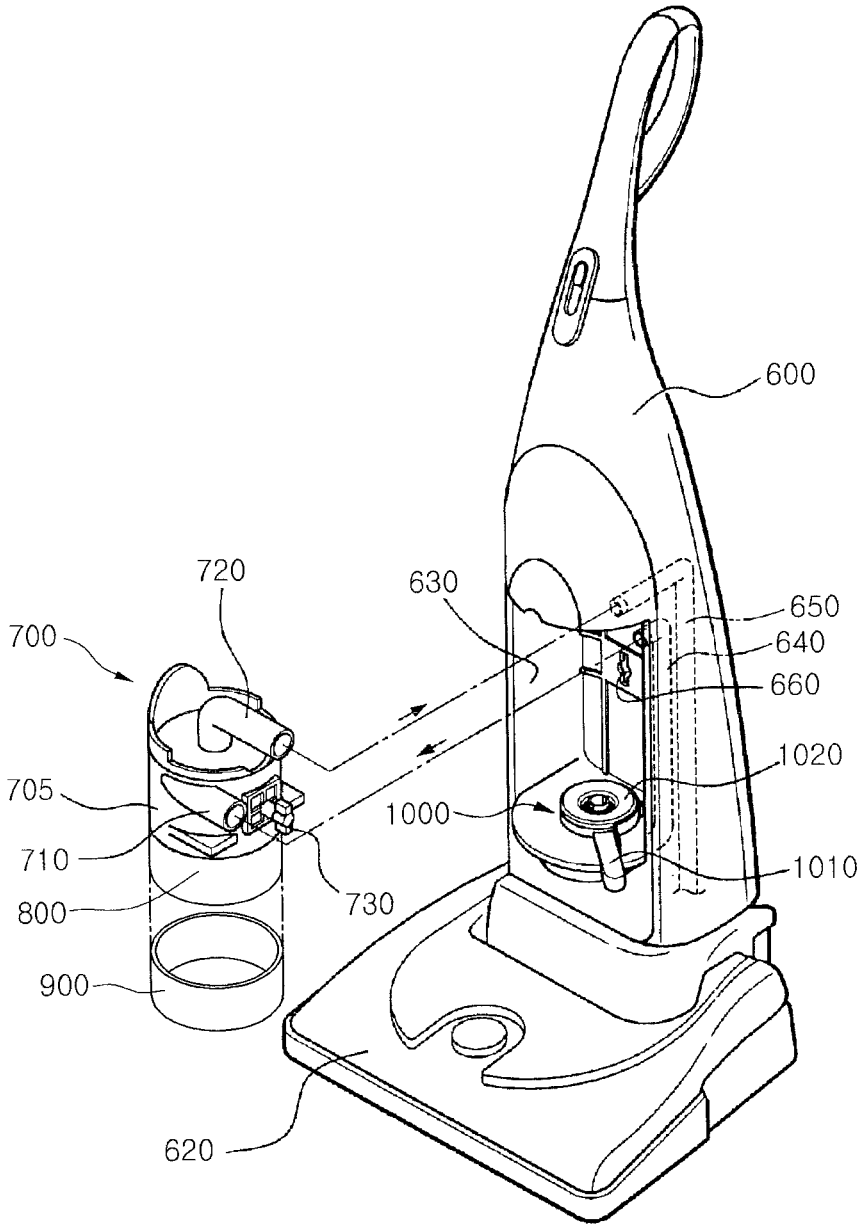
FIG. 11 is an exploded perspective view of a vacuum cleaner according to another embodiment.
Figure 12:
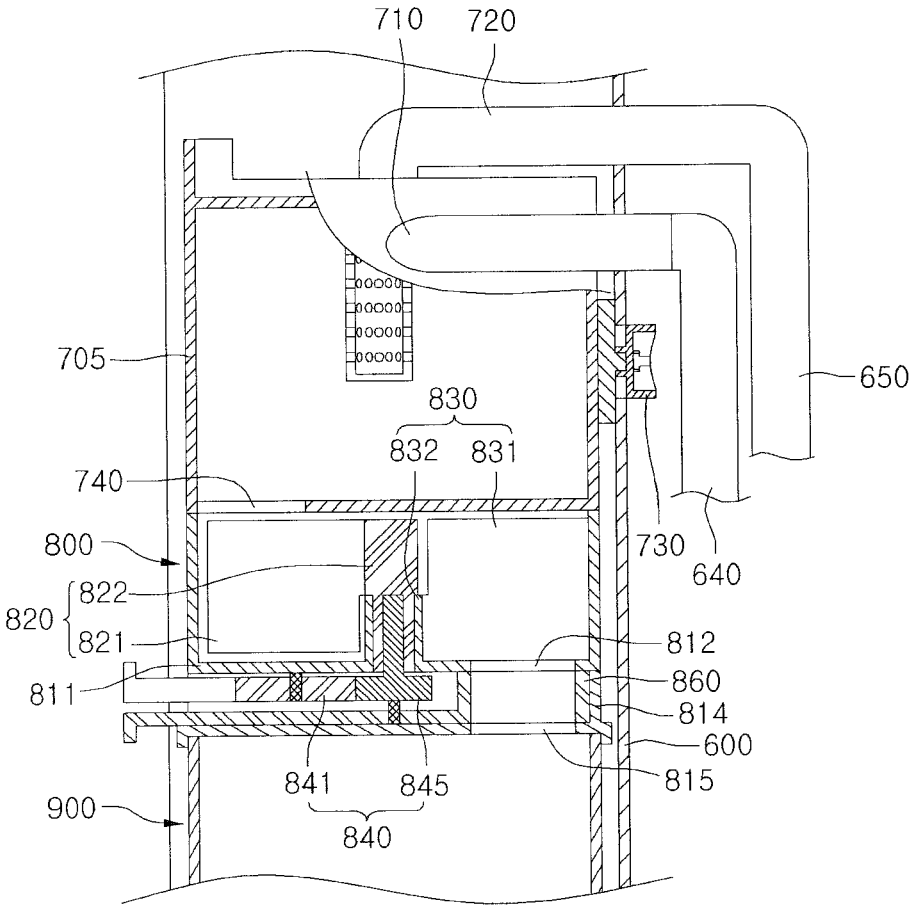
FIG. 12 is a partial cross-sectional view of the vacuum cleaner of FIG. 11 showing a state in which a dust separator is mounted on the vacuum cleaner of FIG. 11.

FIG. 11 is an exploded perspective view of a vacuum cleaner according to another embodiment. FIG. 12 is a partial cross-sectional view of the vacuum cleaner of FIG. 11 showing a state in which a dust separator is mounted on the vacuum cleaner.

Referring to FIGS. 11 and 12, the vacuum cleaner according to this embodiment may include a main body 600 with a suction motor (not shown), a suction nozzle 620, which may be rotatably connected with the main body 600, and a dust separator 700 that separates sucked in dust and stores separated dust. A mounting portion 630 configured to receive the dust separator 700 mounted thereon may be formed in the main body 600. The dust separator 700 may include a dust separation device 705 that separates dust, a compression device 800 that compresses dust separated and discharged from the dust separation device 705, and a dust storage device 900 that stores dust compressed by the compression device 800.

The dust separation device 705 may separate dust from air by a cyclone flow, for example. The compression device 800 may be fixed to a lower part of the dust separation device 705. In the state in which the compression device 800 is fixed to the dust separation device 705, the dust separation device 705 and the compression device 800 may be fixed to the main body 600.

The dust storage device 900 may be removably mounted on the main body 600. In a state in which the dust storage device 900 is mounted on the main body 600, a lower part of the compression device 800 may be coupled with the dust storage device 900 by a locking device 1000. An air introduction portion 710, which may communicate with the suction nozzle 620, may be formed on an upper part of the dust separation device 705. An air discharge portion 720, which may communicate with the suction motor, may be formed at an upper portion of the dust separation device 705. A dust discharge portion 740, through which separated dust may be discharged, may be formed on a lower part of the dust separation device 705.

A first connection tube 640, which may communicate with the suction nozzle 620, and a second connection tube 650, which may communicate with the suction motor, may be provided in the main body 600. Ends of the connection tubes 640 and 650 may face a front of the vacuum cleaner. In correspondence therewith, the introduction portion 710 and the air discharge portion 720 of the dust separation device 705 may be arranged in parallel extending toward a rear side of the vacuum cleaner.

A locking portion 730 may be provided outside of the dust separation device 705. The locking portion 730 may be rotatably connected to the dust separation device 705. A coupling portion 660 may be formed in the main body 600. When the locking portion 730 rotates while passing through the coupling portion 660, the dust separation device 705 coupled with the compression device 800 may be fixed to the main body 600.

The compression device 800 may include a compression body 810 that forms a compression space, a plurality of compression members 820 and 830 that compress dust introduced into the compression body 810, a drive device 840 that drives at least one of the plurality of compression members 820 and 830, and an opening and closing device 860 that selectively communicates the dust storage device 900 with the compression body 810. More specifically, one or more discharge holes 812 that discharge the compressed dust may be formed on a lower wall 811 of the compression body 810. The plurality of compression members 820 and 830 may include a first compression member 820, which may be rotatably provided in the compression body 810, and a second compression member 830, which may be fixed in the compression body 810 and compress dust by interaction with the first compression member 820. The first compression member 820 may be bidirectionally rotated by the drive device 840. In addition, the compressed dust may be stored at both sides of the second compression member 830.

The first compression member 820 may include a first compression plate 821 and a rotational shaft 822, which may be coupled or integrally formed with the first compression plate 821. The second compression member 830 may include a second compression plate 831 that interacts with the first compression plate 821 and a fixed shaft 832, which may be coupled with the rotational shaft 822. The fixed shaft 832 may be integrally formed on the lower wall 811 of the compression body 810. The second compression plate 831 may be integrally formed with the compression body 810. The drive device 840 may include an operation device 841 that generates a driving force and a transmission portion 845 that transmits the driving force of the operation device 841 to the first compression member 820.

Figure 13:
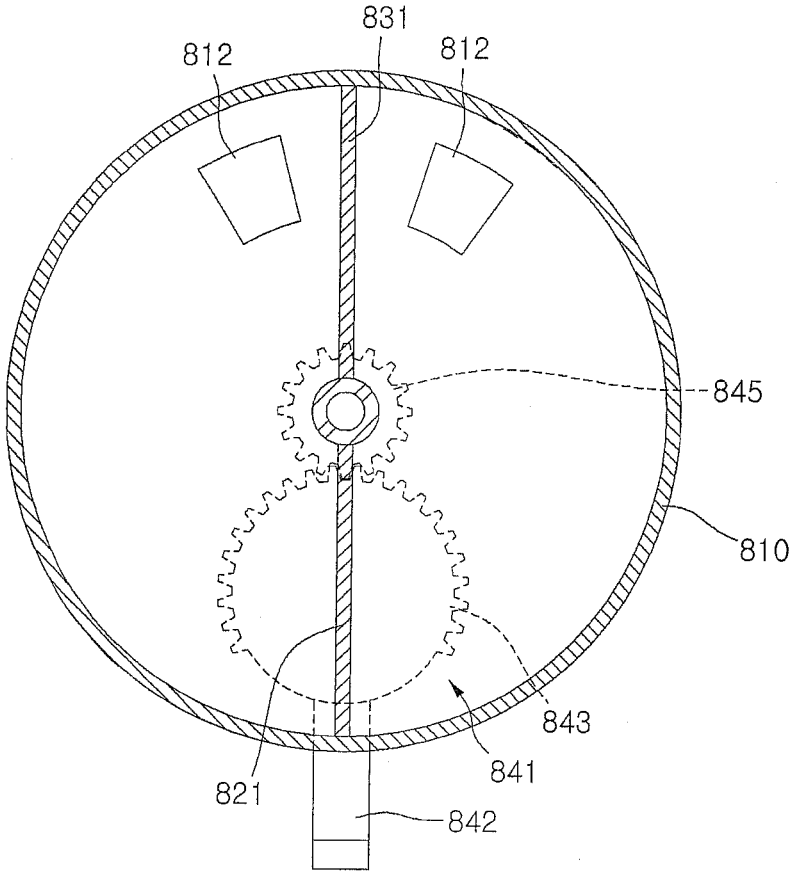
FIG. 13 is a partial horizontal cross-sectional view of a compression device including a drive device according to the embodiment of FIG. 11.

FIG. 13 is a partial horizontal cross-sectional view of a compression device including a drive device according to the embodiment of FIG. 11. In FIG. 13, the opening and closing device is shown removed.

Referring to FIGS. 12 and 13, the operation device 841 may be provided below the lower wall 811. The operation device 841 may include an operation portion 842 for a user's operation and a connection portion 843, which may be formed integrally with the operation portion 842 and connected with the transmission portion 845. The connection portion 843 and the transmission portion 845 may be gears, for example. That is, a plurality of gear teeth may be formed on a periphery of each of the connection portion 843 and the transmission portion 845. The transmission portion 845 may be coupled to the rotational shaft 822 and may penetrate below the lower wall 811.

Figure 14:
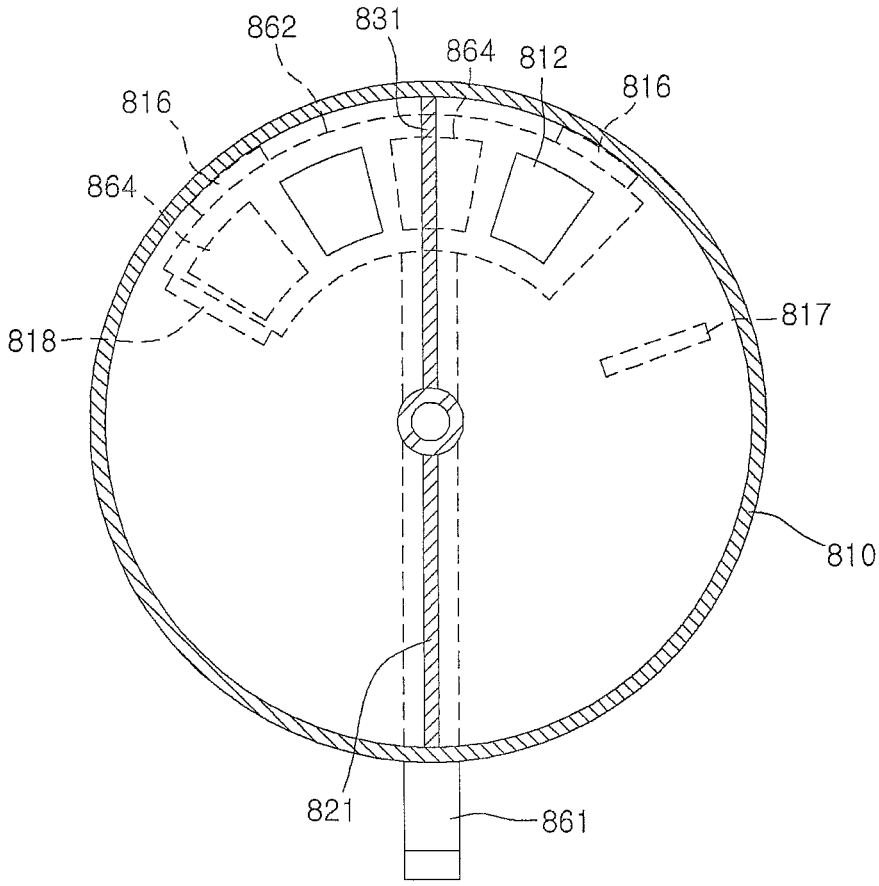
FIGS. 14 and 15 are partial horizontal cross-sectional views showing an opening and closing device according to the embodiment of FIG. 11.
Figure 15:
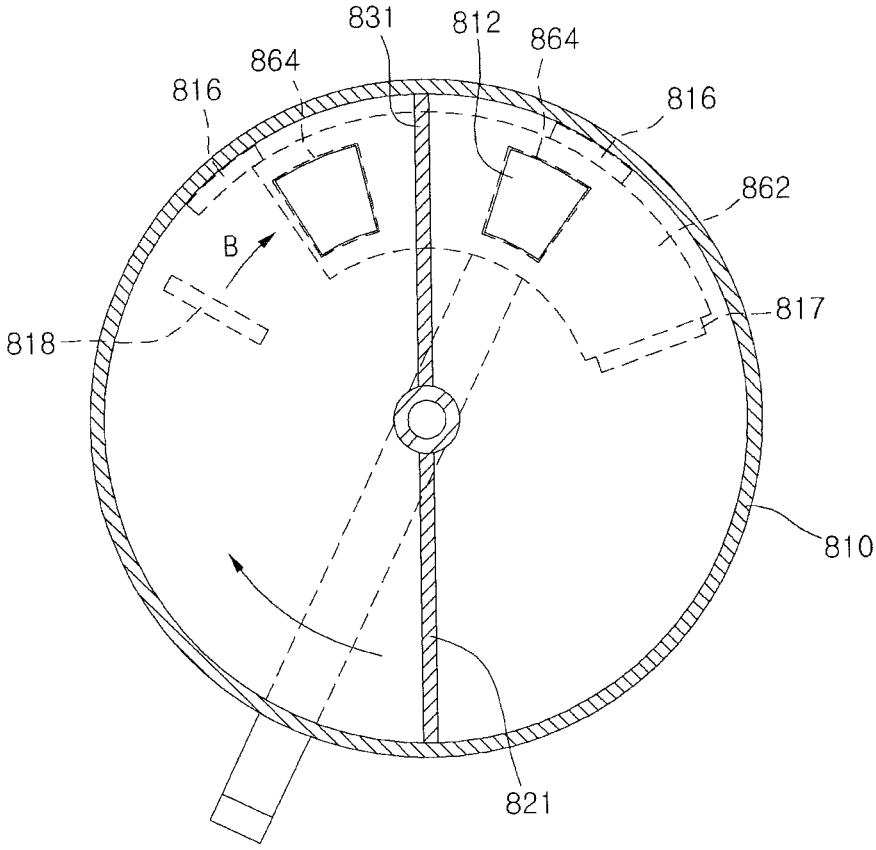

FIGS. 14 and 15 are partial horizontal cross-sectional views showing an opening and closing device according to the embodiment of FIG. 11. In FIG. 14, a state in which the opening and closing device closes a discharge hole is shown, and in FIG. 15, a state in which the opening and closing device opens the discharge hole is shown.

Referring to FIGS. 12 to 15, the opening and closing device 860 may include an operation portion 861 for a user's operation and an opening and closing member 862 that opens and closes the discharge hole(s) 812 by operation of the operation portion 861. The operation portion 861 may be positioned below the drive device 840. Therefore, the operation portion 842 of the driving device 840 and the operation portion 861 of the opening and closing device 860 may be smoothly moved without interference therebetween.

More specifically, a plurality of discharge holes 812 may be formed on the lower wall 811. In the embodiment of FIG. 14, for example, two discharge holes 812 are formed. The opening and closing member 862 may be rotatably provided below the lower wall 811. A rotational center of the opening and closing member 862 may coincide with a rotational center of the rotational shaft 822.

Two communication holes 864 that selectively communicate with the two discharge holes 812 may be formed in the opening and closing member 862. In addition, the drive device 840 and the opening and closing device 860 may be covered by a lower cover 814. Two opening portions 815 may be formed at positions corresponding to the two discharge holes 812 in the lower cover 814.

Therefore, as shown in FIG. 14, in a state in which the communication hole(s) 864 of the opening and closing member 862 are not aligned with the discharge hole(s) 812 of the lower wall 811, the opening and closing member 862 may close the discharge hole(s) 812. On the other hand, as shown in FIG. 15, when the opening and closing member 862 is rotated in a clockwise direction (arrow B in FIG. 15) using the operation portion 861, the discharge hole(s) 812, the communication hole(s) 864, and the opening portion(s) 815 may be aligned. Then, dust accumulated at both sides of the second compression plate 831 may pass through the discharge hole(s) 812, the communication hole(s) 864, and the opening portion(s) 815 in sequence to be discharged to outside of the compression device 800.

Guide ribs 816 that guide movement of the opening and closing member 862 may be formed in or on the lower cover 814. Further, the lower cover 814 may include a first stopper 817 that functions as a stop position when the opening and closing member 862 rotates in a direction to open the discharge hole(s) 812, and a second stopper 818 that functions as a stop position when the opening and closing member 862 rotates in a direction to close the discharge hole(s) 812.

Figure 16:
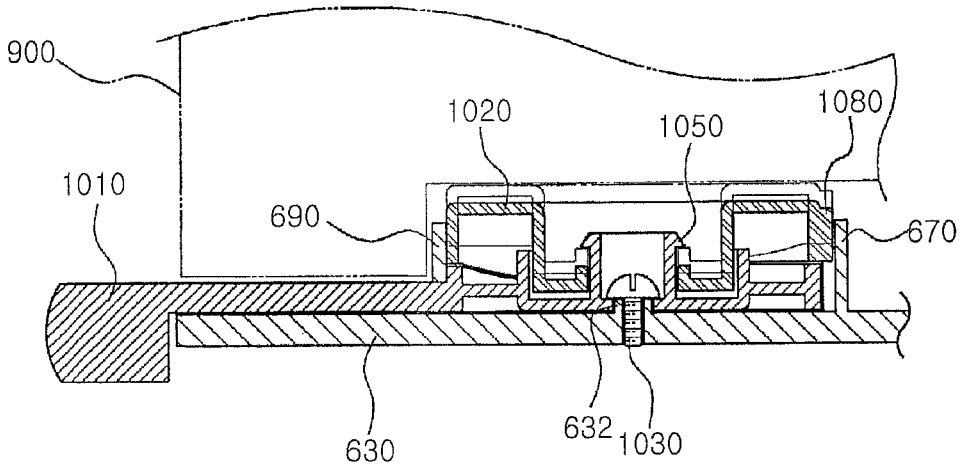
FIG. 16 is a vertical cross-sectional view of a locking device according to the embodiment of FIG. 11.
Figure 17:
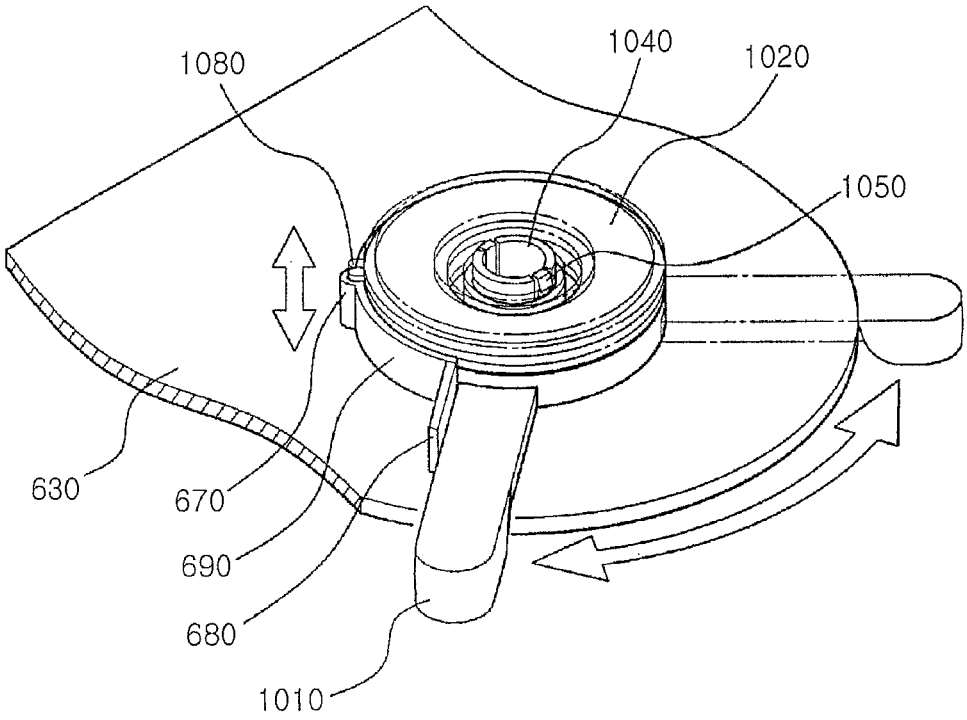
FIG. 17 is a perspective view of the locking device according to the embodiment of FIG. 11.
Figure 18:
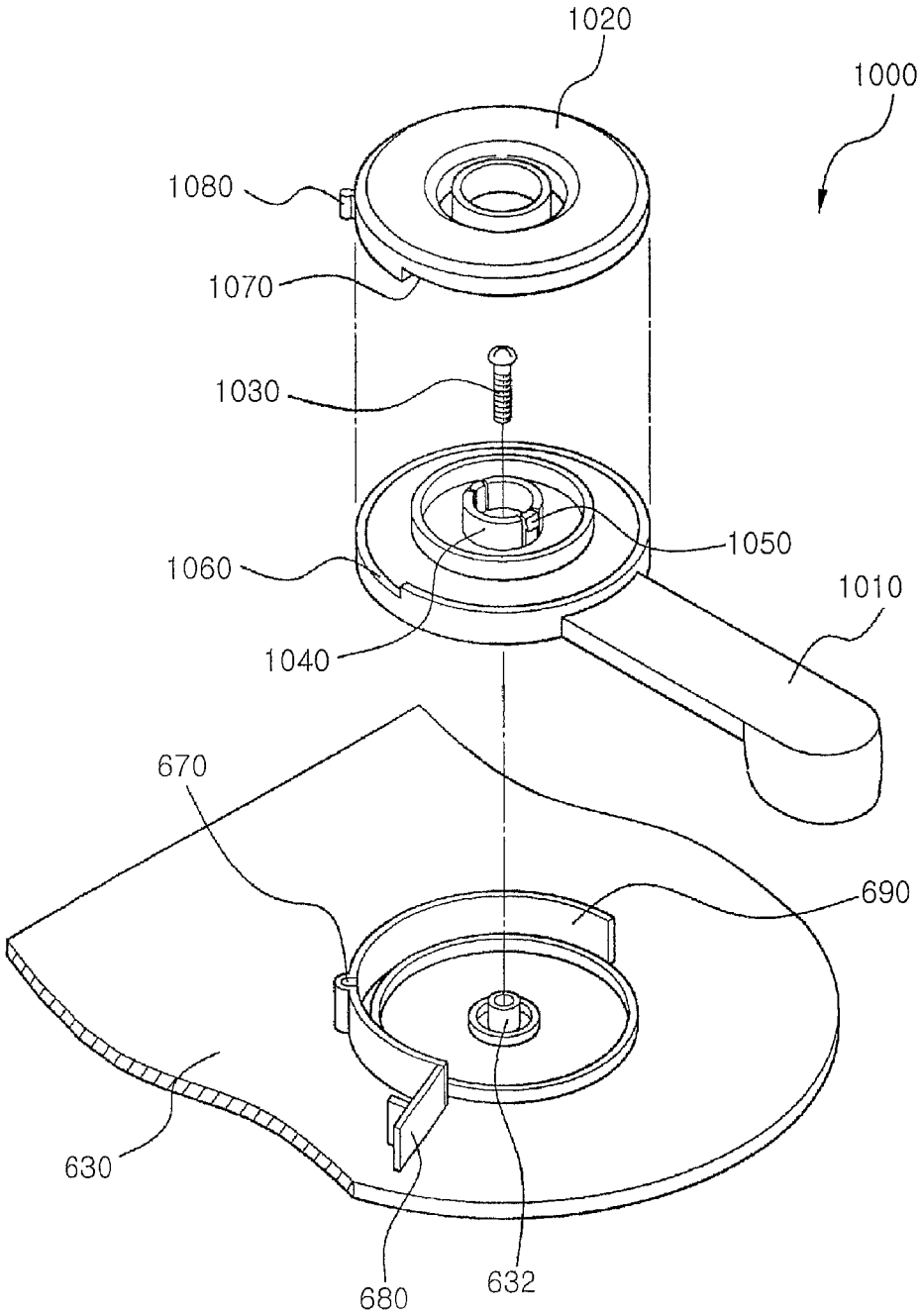
FIG. 18 is an exploded perspective view of the locking device according to the embodiment of FIG. 11.

FIG. 16 is a vertical cross-sectional view of a locking device according to the embodiment of FIG. 11. FIG. 17 is a perspective view of the locking device according to the embodiment of FIG. 11. FIG. 18 is an exploded perspective view of the locking device according to the embodiment of FIG. 11.

Referring to FIGS. 11, 16, and 18, the locking device 1000 may be provided at or on the mounting portion 630. The dust storage device 900 may vertically move while being housed in the mounting portion 630 by the locking device 1000. In addition, in a state in which the dust storage device 900 moves upwards, the dust storage device 900 may be coupled to a lower part of the compression device 800. The locking device 1000 may include an operation lever 1010 and a locking disk 1020. A hinge shaft 632 may be formed on the mounting portion 630. The operation lever 1010 may be rotatably coupled to the hinge shaft 632 by, for example, a screw 1030. A hollow hinge shaft 1040 that protrudes upward may be formed at a rotational center of the operation lever 1010. The locking disk 1020 may be coupled to the hinge shaft 1040 to be vertically movable. In addition, a hook 1050 configured to be coupled with the locking disk 1020 may be formed in or on the operation lever 1010.

A first cam portion 1060 may be formed on an upper part of the operation lever 1010, and a second cam portion 1070 corresponding to the first cam portion 1060 may be formed on a lower part of the locking disk 1020. The locking disk 1020 may move vertically on the hinge shaft 1040 by interaction of the pair of cam portions 1060 and 1070. A protrusion 1080 may be formed at one side of an outer peripheral surface of the locking disk 1020 and a guide portion 670 that prevents rotation of the locking disk 1020 by engaging with the protrusion 1080 may be formed on the mounting portion 630. A stopper 680 that stops the operation lever 1010 from rotation in one direction may be formed in or on the mounting portion 630.

As shown in FIG. 17, when the operation lever 1010 is rotated in a clockwise direction (when viewed from above), the locking disk 1020 falls, such that the dust storage device 900 may be separated from the compression device 800. On the other hand, when the operation lever 1010 is rotated in a counter-clockwise direction (when viewed from above), the locking disk 1020 rises, such that the dust storage device 900 may be coupled with the lower part of the compression device 800. Meanwhile, in FIG. 17, reference numeral 690 represents a supporter that prevents the lower part of the dust storage device 900 from contacting the locking device 1000 by supporting the dust storage device 900 when the locking device 1000 is unlocked (the dust storage 900 device is separated from the compression device 800).

According to this embodiment, in a state in which the dust storage device 900 and the compression device 800 are fixed to the main body 60, dust may be removed by separating only the dust storage device 900 from the main body 600. Accordingly, a user may discharge dust from the dust storage device 900 with low effort.

Figure 19:
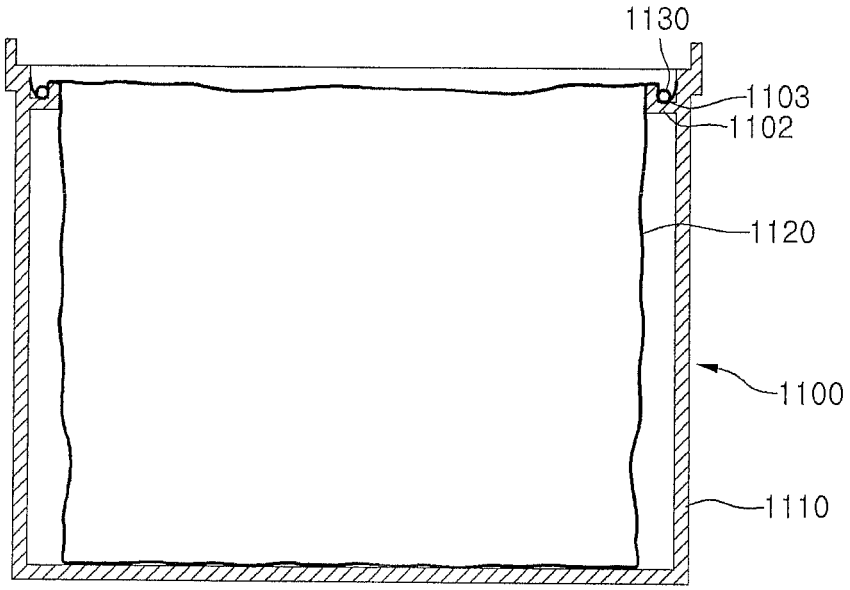
FIG. 19 is a vertical cross-sectional view of a dust storage device according to another embodiment.

FIG. 19 is a vertical cross-sectional view of a dust storage device according to another embodiment. This embodiment is the same as any one of the previous embodiments except for an additional dust bag that stores dust provided in the dust storage device. Therefore, repetitive disclosure has been omitted.

Referring to FIG. 19, the dust storage device 1100 according to this embodiment may include a dust tank 1110 having a space formed therein, a dust bag 1120 housed in the dust tank 1110 that stores dust discharged from the compression device, and a fixing device 1130 that fixes the dust bag 1120 to the dust tank 1110. More specifically, the dust bag 1120 may be, for example, paper or vinyl; however embodiments are not limited thereto.

The dust tank 1110 may open upwards. A coupling portion 1102 configured to be coupled with the fixing device 1130 may be formed on an inner peripheral surface of the dust tank 1110. The coupling portion 1102 may be continuously formed on the inner peripheral surface of the dust tank 1110 and may extend toward a center portion of the dust tank 1110 on the inner peripheral surface. The coupling portion 1102 may have a substantially "L"-shaped cross section in order to seat the fixing device 1130. Therefore, a seating portion 1103, on which the fixing device 1130 may be seated, may be formed in the coupling portion 1102.

The fixing device 1130 may be made of a material having elastic force. For example, the fixing device 1130 may be made of a rubber material and may have a ring shape.

A peripheral length of the fixing device 1130 may be smaller than a peripheral length of the seating portion 1103 in order to increase a coupling force between the fixing device 1130 and the coupling portion 1102. Then, as the fixing device 1130 is coupled with the coupling portion 1102, the coupling force between the fixing device 1130 and the coupling portion 1102 may increase.

An end portion of the dust bag 1120 may closely contact the coupling portion 1120 in order to fix the dust bag 1120 to the dust tank 1110. Thereafter, the fixing device 1130 may be coupled to the coupling portion 1102. Then, the dust bag 1120 may be fixed in the state in which the end portion of the dust bag 1120 is positioned between the fixing device 1130 and the coupling portion 1102 by the elastic force of the fixing device 1130.

According to this embodiment, as compressed dust is stored in the dust bag 1120 which is housed in the dust tank 1110, the dust bag 1120 may be disposed of by separating only the dust bag 1120 from the dust tank 1110, thereby improving user convenience and preventing dust from getting on a user's hands. Further, as dust is prevented from getting on the dust tank 1110, a problem in that the dust tank 1110 must be cleaned is reduced or removed.

Figure 20:
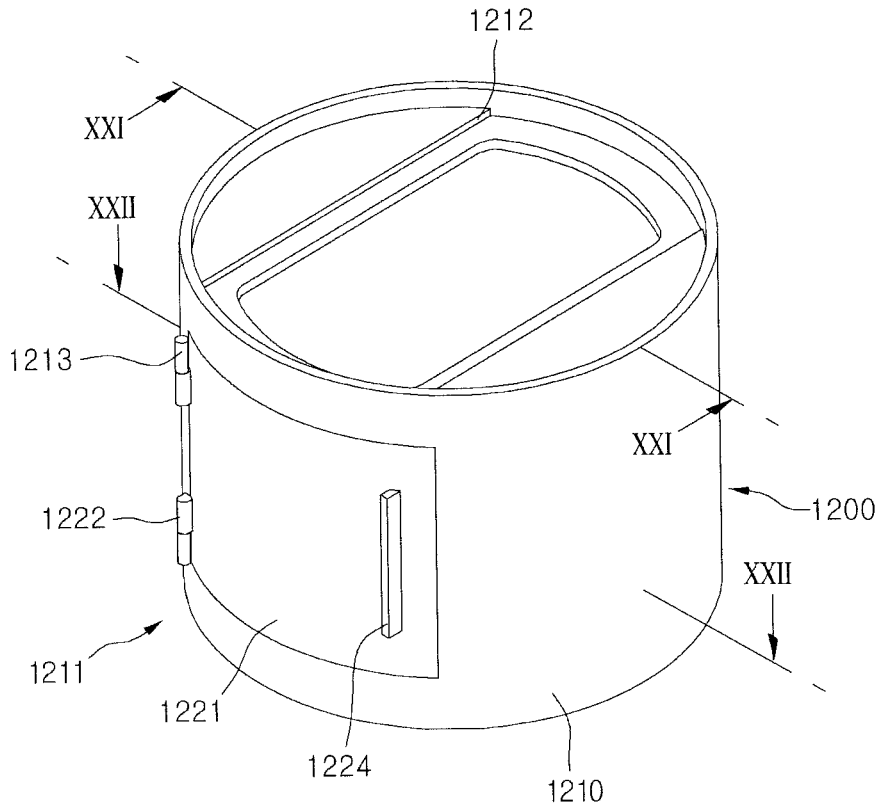
FIG. 20 is a perspective view of a dust storage device according to another embodiment.
Figure 21:
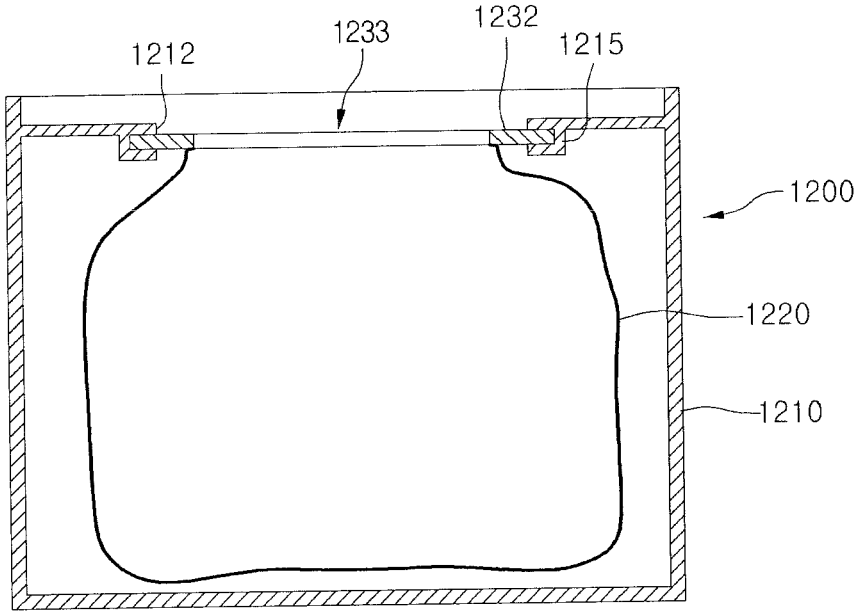
FIG. 21 is a cross-sectional view taken along line XXI-XXI of FIG. 20.
Figure 22:
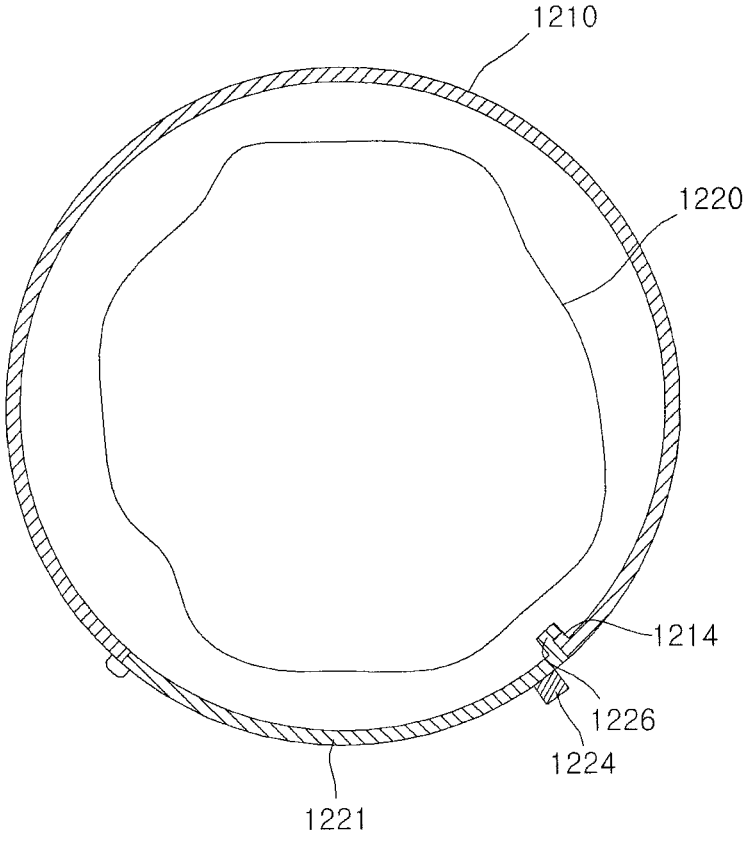
FIG. 22 is a cross-sectional view taken along line XXII-XXII of FIG. 20.
Figure 23:
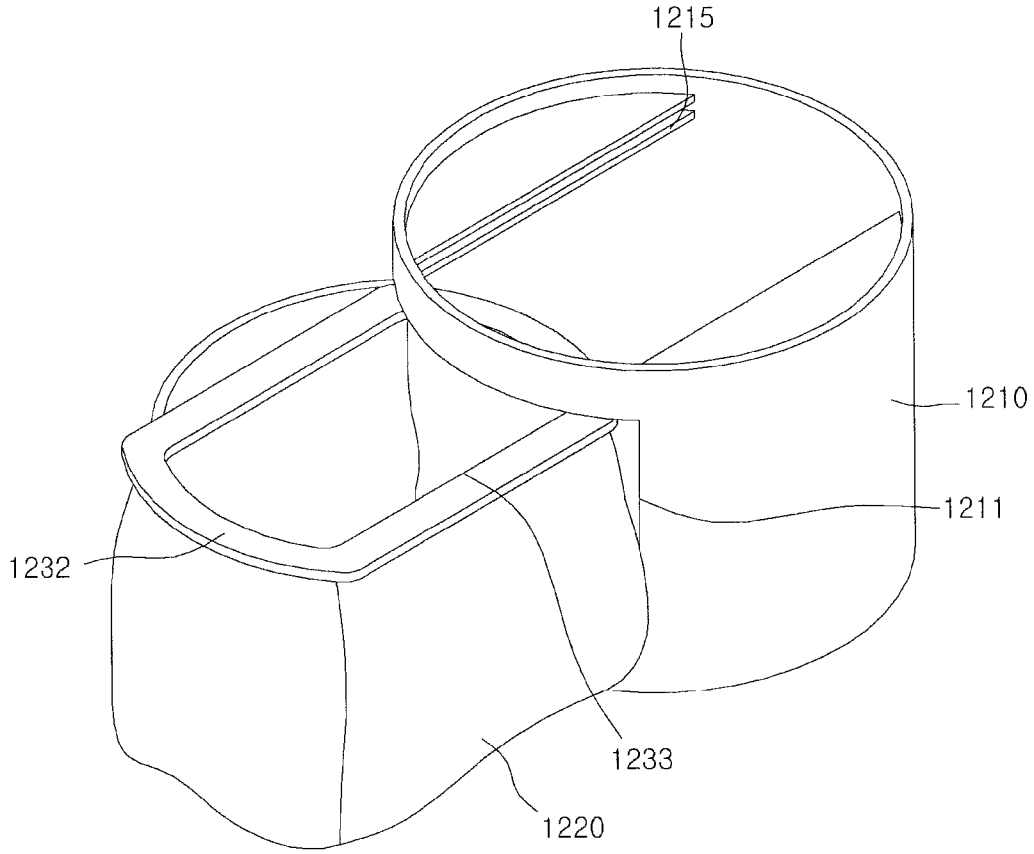
FIG. 23 is a perspective view of a dust storage device in a state in which a cover member rotates according to the embodiment of FIG. 20.

FIG. 20 is a perspective view of a dust storage device according to another embodiment. FIG. 21 is a cross-sectional view taken along line XXI-XXI of FIG. 20. FIG. 22 is a cross-sectional view taken along line XXII-XXII of FIG. 20. FIG. 23 is a perspective view of a dust storage device in a state in which a cover member rotates according to the embodiment of FIG. 20. This embodiment is the same as any one of the previous embodiments except for an additional dust bag that stores dust provided in the dust tank. Therefore, repetitive disclosure has been omitted.

Referring to FIGS. 20 to 23, a dust storage device 1200 according to this embodiment may include a dust tank 1210 having a space formed therein and a dust bag 1220, which may be housed in the dust tank 1210 to store dust compressed by the compression device. More specifically, a dust introduction hole 1212, into which the compressed dust may be introduced, may be formed on an upper part of the dust tank 1210. In addition, an opening portion 1211, through which the dust bag 1220 may be draw in and out, may be formed on a side wall of the dust wall 1210. Further, the opening portion 1211 may be opened and closed by a cover member 1221. One side of the cover member 1221 may be rotatably coupled to the dust tank 1210, for example, by a hinge 1222. In addition, the other side the cover member 1220 may be selectively coupled to the dust tank by, for example, a hook 1226.

A hinge coupling portion 1213, to which the hinge 1222 may be coupled, may be formed on an outer peripheral surface of the dust tank 1210, and a hook engagement portion 1214, in which the hook 1226 may engage, may be formed on an inner peripheral surface of the dust tank 1210. In addition, a handle 1224 for a user's easy operation may be formed in or on the cover member 1221. The dust bag 1220 may be, for example, paper or vinyl; however embodiments are not limited thereto.

An end portion of the dust bag 1220 may be coupled to a support portion 1232 that supports the dust bag 1220 while fixing the dust bag 1220 to the dust tank 1210. A through-hole 1233, through which dust may pass, may be formed in the support portion 1232. The support portion 1232 may be inserted into the dust tank 1210 through the opening portion 1211 in a state in which the cover member 1221 opens the opening portion 1211. The support portion 1232 may be slidingly-coupled to the dust tank 1210, for example. For this, a coupling portion 1215 configured to be coupled with the support portion 1232 may be formed on an upper part of the dust tank 1210. The coupling portion 1215 may have, for example, an "L" shape. When the support portion 1232 is slidingly-coupled to the coupling portion 1215, the through-hole 1233 and the dust introduction hole 1212 may be aligned.

Referring to FIG. 20, the cover member 1221 may be rotated in one direction with the handle 1224 in order to replace the dust bag 1220. Then, the opening portion 1211 of the dust tank 1210 may be opened. Thereafter, when the support portion 1232 is pulled out the dust tank 1210 by a user gripping the support portion 1232, the support portion 1232 may be slidingly-drawn out from the dust tank 1210 through the opening portion 1211.

The dust bag 1220 may be replaced, even in a state in which the dust tank 1210 is mounted on the main body. Therefore, as a user may draw out the dust bag 1220 from the dust tank 1210 by opening the opening portion 1211 without removing the dust tank 1210 from the main body in order to replace the dust bag 1220, it may be possible to improve user convenience.

Figure 24:
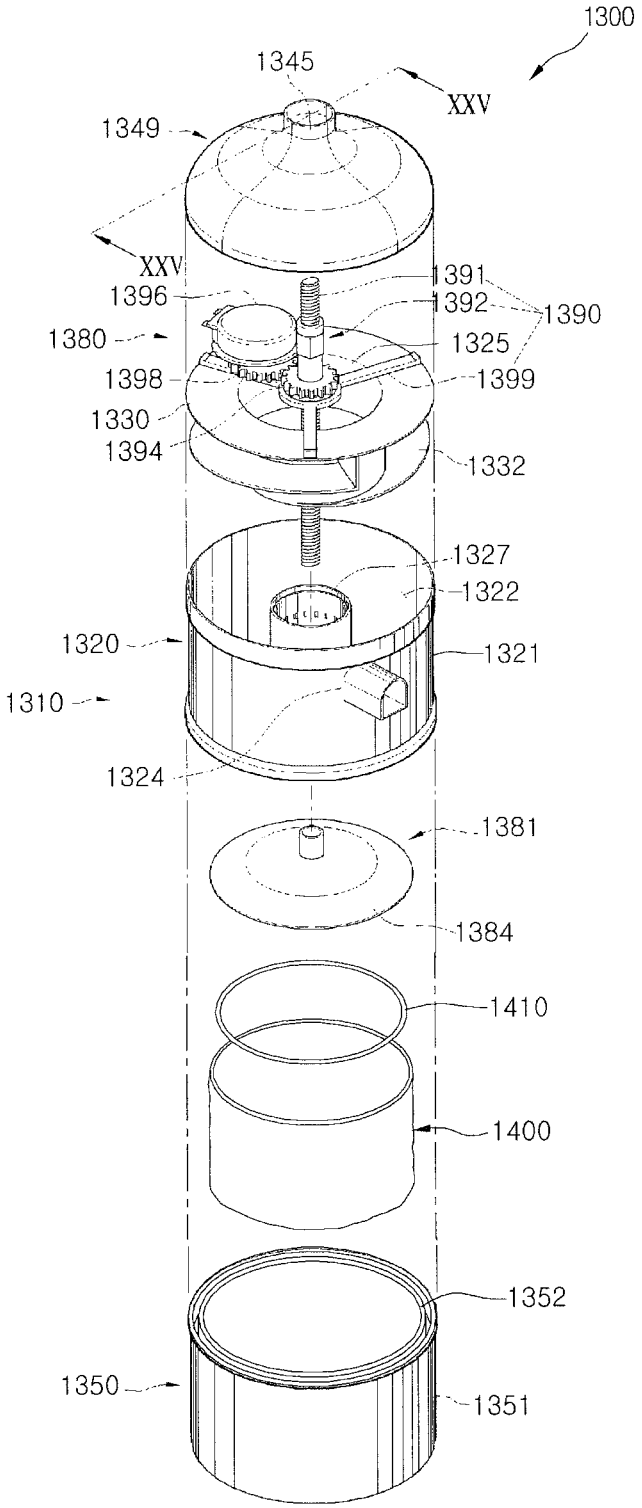
FIG. 24 is an exploded perspective view of a dust separator according to another embodiment.
Figure 25:
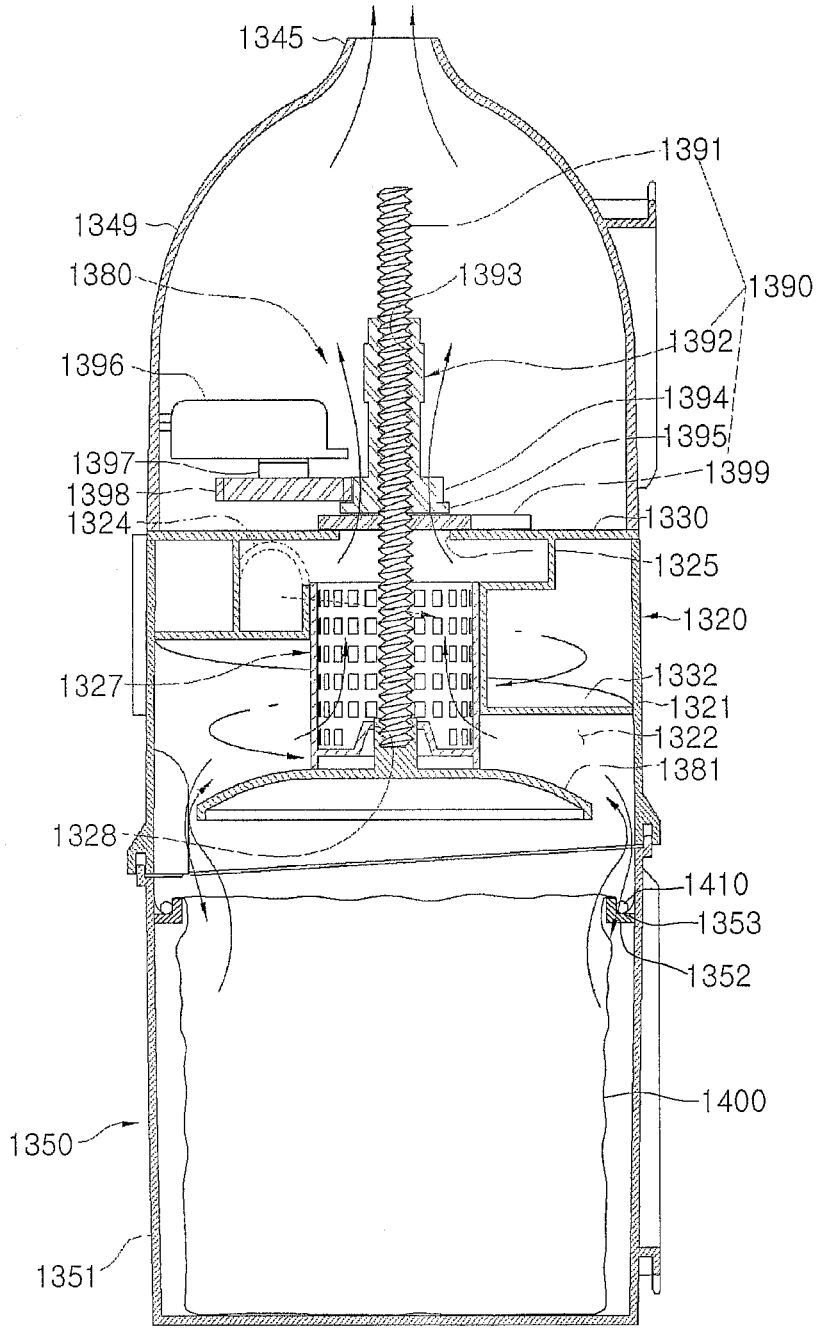
FIG. 25 is a cross-sectional view taken along line XXV-XXV of FIG. 24.
Figure 26:
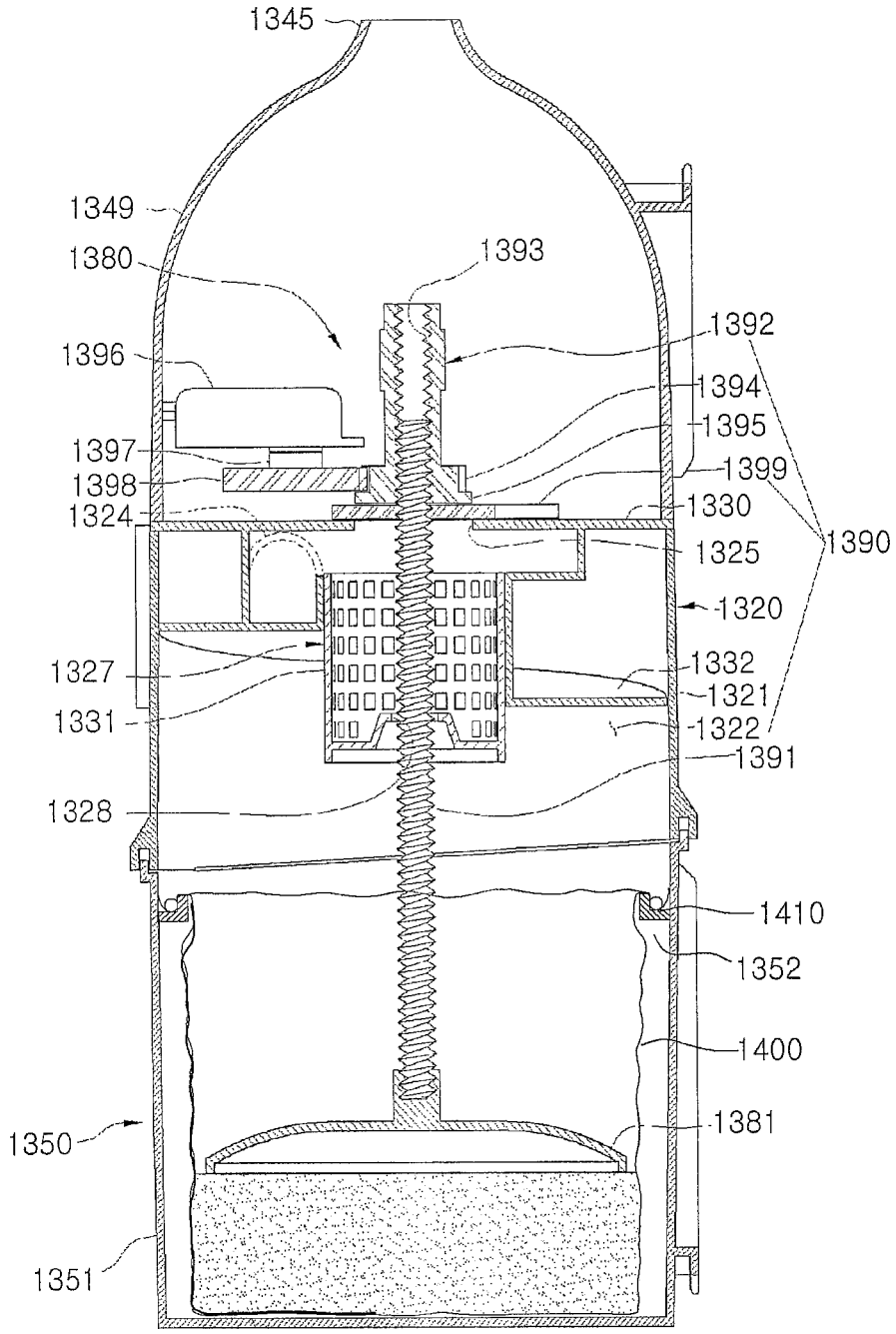
FIG. 26 is a cross-sectional view taken along line XXV-XXV of FIG. 24 in a state in which dust is compressed.

FIG. 24 is an exploded perspective view of a dust separator according to another embodiment. FIG. 25 is a cross-sectional view taken along line XXV-XXV of FIG. 24. FIG. 26 is a cross-sectional view taken along line XXVI-XXVI of FIG. 24 in a state in which dust is compressed.

Referring to FIGS. 24 to 26, the dust separator 1300 according to this embodiment may include a dust separation device 1310 that separates dust, a cover member 1349 that covers an upper part of the dust separation device 1310, a dust storage device 1350, which may be removably coupled to a lower part of the dust separation device 1310, and a compression device 1380 that compresses dust stored in the dust storage device 1350. More specifically, the dust separation device 1310 may include a cyclone portion 1320 that separates dust in air by a cyclone flow. The cyclone portion 1320 may include a cyclone body 1321, which may have a substantially cylindrical shape and form a cyclone chamber 1322. An upper part and a lower part of the cyclone body 1321 may be open. An air suction portion 1324 that sucks the air including the dust may be formed in the cyclone body 1321.

A guide portion 1330 that guides a flow of air may be provided in the cyclone body 1321. An air discharge hole 1325 that discharges air without dust may be formed at a center portion of the air guide portion 1330. In addition, an exhaust member 1327 that filters discharged air may be coupled to the air guide portion 1330. A plurality of holes through which air may pass, may be formed in the exhaust member 1327.

An air guide blade 1332 may be formed in a lower portion of the air guide portion 1330. The air guide blade 1332 may be in a spiral form outside of the exhaust member 1327. Therefore, air sucked through the air suction portion 1324 may form a cyclone while being guided by the air guide blade 1332, and thereafter, may be introduced into the cyclone chamber 1322.

The cover member 1349 may guide discharge of air passing through the exhaust member 1327. A discharge pipe 1345 that discharges air may be provided in the cover member 1349.

The dust storage device 1350 may include a dust tank 1351, which may be cylindrical and an upper part of which may be open and a lower part of which may be closed. The dust tank 1351 may be removably mounted on a lower part of the cyclone portion 1320.

A dust bag 1400 that stores dust separated from the cyclone portion 1320 may be housed in the dust tank 1351. The dust bag 1400 may be removably fixed to the dust tank 1351 by a fixing device 1410. The dust bag 1400 may be, for example, paper or vinyl; however, embodiments are not limited thereto.

A coupling portion 1352 configured to be coupled with the fixing device 1410 may be formed on an inner peripheral surface of the dust tank 1351. The coupling portion 1352 may be continuously formed on the inner peripheral surface of the dust tank 1351. In addition, the coupling portion may extend toward a center portion of the dust tank 1351 on the inner peripheral surface of the dust tank 1351. The coupling portion 1352 may have a substantially "L"-shaped cross section in order to seat the fixing device 1410. Therefore, a seating portion 1353 configured to seat the fixing device 1410 may be formed in the coupling portion 1352.

The fixing device 1410 may be made of a material having an elastic force. For example, the fixing device 1410 may be made of a rubber material and may have a ring shape.

A peripheral length of the fixing device 1410 may be smaller than a peripheral length of the seating portion 1353 in order to increase a coupling force between the fixing device 1410 and the coupling portion 1352. As the fixing device 1410 extends from and is coupled to the coupling portion 1352, a coupling force between the fixing device 1410 and the coupling portion 1352 may be increased.

An end portion of the dust bag 1400 may closely contact the coupling portion 1352 in order to fix the dust bag 1400 to the dust tank 1351. Thereafter, the fixing device 1410 may be coupled to the coupling portion 1352. Then, the dust bag 1400 may be fixed in a state in which the end portion of the dust bag 1400 is positioned between the fixing device 1410 and the coupling portion 1352 by the elastic force of the fixing device 1410.

The dust compression device 1380 may compress the dust stored in the dust bag 1400. The dust compression device 1380 may include a compression plate 1381, an elevation portion 1390, and a drive or compression motor 1396. The compression plate 1381 may compress the dust stored in the dust bag 1400 and may be disposed below the exhaust member 1327 in the cyclone body 1321.

As shown in FIG. 25, the compression plate 1381 may include a disk plate 1384 having a flat lower part. In addition, a diameter of the compression plate 1381 may be smaller than an inner peripheral surface of the coupling portion 1352, so that the compression plate 1381 may pass through the coupling portion 1352. The compression plate 1381 may additionally serve as a backward flow prevention plate that prevents the dust stored in the dust bag 1400 from being again scattered with the cyclone air and flowing backward to the exhaust member 1327.

An elevation portion 1390 may elevate the compression plate 1381. The elevation portion 1390 may include a movement shaft 1391, a cylindrical gear 1392, and a support bracket 1399.

The movement shaft 1391 may be connected to an upper part of the compression plate 1381 and a thread may be formed on an outer peripheral surface thereof. The movement shaft 1391 may pass through the exhaust member 1327 and the air discharge hole 1325.

A shaft through-hole 1393, through which the movement shaft 1391 may pass, may be formed on an inner periphery of the cylindrical gear 1392. A thread having a shape corresponding to the thread of the movement shaft 1391 may be formed on an inner periphery of the shaft through-hole 1393. In addition, when the cylindrical gear 1392 rotates in one direction, for example, a clockwise direction, the movement shaft 1391 may fall, and when the cylindrical gear 1392 rotates in the other direction, for example, in a counter-clockwise direction, the movement shaft 1391 may rise.

A plurality of gear teeth 1394 that engage with a drive gear 1398 of the drive motor 1396 may be formed on a lower outer peripheral surface of the cylindrical gear 1392. When the cylindrical gear 1392 is rotated in one direction by the drive gear 1398, a circular extension jaw 1395 may be formed below the gear teeth 1394 of the cylindrical gear 1392 in order to prevent the cylindrical gear 1392 from rising with the movement shaft 1391.

The cylindrical gear 1392 may be rotatably supported on the support bracket 1399. The support bracket 1399 may serve to support the cylindrical gear 1392 and prevent the cylindrical gear 1392 from falling with the movement shaft 1391 through the air discharge hole 1325 when the cylindrical gear 1392 is rotated in the other direction, that is, in a counter-clockwise direction by the drive gear 1398.

As shown in FIG. 24, the support bracket 1399 may be formed in a Y shape and fixed to an upper part of the air guide portion 1330. The drive motor 1396 may be fixed onto an inner surface of the cover member 1349.

In addition, when a controller (not shown) drives the drive motor 1396, the cylindrical gear 1392 may be rotated in one direction by the drive gear 1398. Then, the movement shaft 1391 and the compression plate 1381 may fall to compress the dust stored in the dust bag 1400. On the other hand, when the cylindrical gear 1392 is rotated in the other direction by the drive gear 1398, the movement shaft 1391 and the compression plate 1381 may rise.

The controller may control rotation of the drive motor 1396 by sensing a load of the drive motor 1396 at a time of compressing the dust. That is, when the compression plate 1381 does not fall any more in compressing the dust, an overload may be generated in the drive motor 1396. The controller may sense the overload of the drive motor 1396 by, for example, circuitarily sensing current variation depending on load variation and may stop driving of the drive motor 1396. In addition, the controller may drive the drive motor 1396 in a reverse direction. When the drive motor 1396 rotates in the reverse direction, the compression plate 1381 and the movement shaft 1391 may rise. In addition, when the compression plate 1381 does not continue to rise while being in close contact with the exhaust member, operation of the drive motor may be stopped by the controller.

The drive motor 1396 may automatically operate along with operation of the suction motor or may operate by selection of a user compression button (not shown). In addition, when an ON signal of the drive motor 1396 is generated, the drive motor 1396 may be driven only until the compression plate 1381 compresses the dust stored in the dust bag 1400 one time or may be driven so that the compression plate 1381 continuously reciprocates in a vertical direction.

According to this embodiment, the dust stored in the dust bag 1400 housed in the dust tank 1351 may be compressed. Accordingly, as the dust bag 1400 may be disposed of merely by separating the dust bag 1400 from the dust tank 1351, user convenience may be improved and contamination of a user's hands with dust may be prevented. Further, as the dust tank 1351 may be prevented from being contaminated with dust, a problem in that the dust tank 1351 must be cleaned is reduced or removed.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A vacuum cleaner, comprising:
- a main body; and
- a dust separator mounted on the main body, the dust separator comprising:
  - a dust separation device;
  - a dust compression device having a compression body forming a compression chamber, the compressor body being provided with at least one compression member configured to compress dust; and
  - a storage device having a storage chamber that stores compressed dust, wherein the storage device is disposed below the dust compression device, wherein the dust compression body comprises a first wall having at least one dust introduction portion and a second wall disposed opposite the first wall having at least one discharge hole through which compressed dust compressed by the at least one compression member is discharged, wherein the storage device comprises a dust inlet to which the compressed dust is introduced, and wherein the second wall is disposed between the compression chamber and the storage chamber.

2. The vacuum cleaner of claim 1, wherein the at least one compression member comprises a rotatable first compression member and a fixed second compression member that compresses dust by interaction with the first compression member.

3. The vacuum cleaner of claim 2, wherein the first compression member comprises:
- a rotatable shaft that extends substantially perpendicular to the second wall; and
- a compression plate attached to the rotatable shaft.

4. The vacuum cleaner of claim 3, wherein the second compression member comprises:
- a fixed shaft; and
- a compression plate attached to fixed shaft.

5. The vacuum cleaner of claim 3, further comprising a drive device that rotates the first compression member.

6. The vacuum cleaner of claim 5, wherein the drive device is provided below a lower wall of the compression body.

7. The vacuum cleaner of claim 5, wherein the drive device comprises:
- an operation device that generates a driving force; and
- a transmission portion connected to the rotatable shaft that transmits the driving force of the operation device to the rotatable shaft.

8. The vacuum cleaner of claim 7, wherein the operation device comprises:
- an operation portion configured to be operated by a user; and
- a connection portion connected with the transmission portion.

9. The vacuum cleaner of claim 8, wherein the connection portion and the transmission portion comprise gears.

10. The vacuum cleaner of claim 9, wherein a diameter of the connection portion is larger than a diameter of the transmission portion so that when the connection portion rotates a first angle, the transmission portion rotates a second angle larger than the first angle.

11. The vacuum cleaner of claim 1, wherein the dust compression device further comprises an opening and closing device configured to allow or block communication between the dust compression device and the dust storage device.

12. The vacuum cleaner of claim 11, wherein the opening and closing device comprises:
- an opening and closing member; and
- an operation member configured to operate the opening and closing member to allow or block communication between the dust compression device and the dust storage device.

13. The vacuum cleaner of claim 12, wherein the operation member is configured to rotate the opening and closing member to a first position, at which at least one opening in the opening and closing member aligns with the at least one discharge hole in the compression body to allow communication between the dust compression device and the dust storage device, or to a second position, at which the opening and closing member blocks the at least one discharge hole in the compression body to block communication between the dust compression device and the dust storage device.

14. The vacuum cleaner of claim 1, wherein the at least one dust introduction portion and the dust inlet are disposed in substantially parallel planes.

15. The vacuum cleaner of claim 1, wherein the at least dust introduction portion and the at least one discharge hole are disposed on opposite walls of the compression body.

16. The vacuum cleaner of claim 1, wherein the first wall is an upper wall of the compression body and the second wall is a lower wall of the compression body.

17. The vacuum cleaner of claim 1, wherein the storage device corresponds in shape to the dust compression device.

* * * * *